US008759766B2

(12) United States Patent
Momomura et al.

(10) Patent No.: US 8,759,766 B2
(45) Date of Patent: Jun. 24, 2014

(54) AIR SUPPLY TUBE, AIR SUPPLY DEVICE, AND IMAGE FORMING APPARATUS

(75) Inventors: Yasunori Momomura, Kanagawa (JP); Kazuki Inami, Kanagawa (JP); Yuki Nagamori, Kanagawa (JP); Koji Otsuka, Kanagawa (JP); Masafumi Kudo, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 108 days.

(21) Appl. No.: 13/440,538

(22) Filed: Apr. 5, 2012

(65) Prior Publication Data

US 2013/0153764 A1 Jun. 20, 2013

(30) Foreign Application Priority Data

Dec. 15, 2011 (JP) ..... 2011-274470

(51) Int. Cl.
*H01T 19/00* (2006.01)

(52) U.S. Cl.
USPC ..... 250/324; 250/423 R; 250/424; 250/426; 250/326

(58) Field of Classification Search
USPC ..... 250/324, 326, 423 R, 424, 425, 426, 250/423 P, 423 F
See application file for complete search history.

(56) References Cited

U.S. PATENT DOCUMENTS

| | | | | |
|---|---|---|---|---|
| 7,829,848 | B2 * | 11/2010 | Takada et al. | 250/288 |
| 2010/0025576 | A1 * | 2/2010 | Adams | 250/288 |
| 2010/0213370 | A1 * | 8/2010 | Nakasuji et al. | 250/310 |

FOREIGN PATENT DOCUMENTS

| | | |
|---|---|---|
| JP | A-10-198128 | 7/1998 |

* cited by examiner

*Primary Examiner* — Nicole Ippolito
*Assistant Examiner* — Hanway Chang
(74) *Attorney, Agent, or Firm* — Oliff PLC

(57) ABSTRACT

Provided is an air supply tube including an inlet port that takes in air, an outlet port that is arranged opposite a portion of an elongated target structure in a longitudinal direction, to which air taken in from the inlet port is to be supplied, and has an elongated opening shape, a channel portion in which a channel space for allowing air to flow between the inlet port and the outlet port is formed, and plural suppressing portions that suppress the flow of air, wherein the plural suppressing portions include at least a most downstream suppressing portion, a first upstream suppressing portion that is provided in a part initially located on the upstream side in the air flow direction, and a gap regulating portion that forms an extended gap at the same interval.

10 Claims, 27 Drawing Sheets

AIR SUPPLY TUBE, AIR SUPPLY DEVICE, AND IMAGE FORMING APPARATUS

CROSS-REFERENCE TO RELATED APPLICATIONS

This application is based on and claims priority under 35 USC 119 from Japanese Patent Application No. 2011-274470 filed Dec. 15, 2011.

BACKGROUND (i) Technical Field

The present invention relates to an air supply tube, an air supply device, and an image forming apparatus.

(ii) Related Art

An image forming apparatus which forms an image made of a developer on a recording sheet uses, for example, a corona discharger which performs corona discharge during a process in which a latent image holding member, such as a photoreceptor, is electrically charged or erased, a process in which an unfixed image is transferred to a recording sheet, or the like.

In a corona discharger, an air supply device is also provided to supply air to constituent components, thereby preventing unwanted substances, such as paper dust or corona products, from becoming attached to constituent components, such as a discharge wire or a grid electrode. In this case, the air supply device generally has an air supply which supplies air and a duct (air supply tube) which guides and sends air sent from the air supply to a target structure, such as a corona discharger.

In the related art, various improvements are made to an air supply device such that air is supplied uniformly relative to the longitudinal direction of constituent components, such as a discharge wire. In particular, an air supply device or the like uses the following configuration, not a configuration in which a channel space, through which air of a duct flows, has a special shape, a configuration in which a rectifier plate or the like is provided to regulate the direction in which air flows in the channel space of the duct, or the like.

SUMMARY

According to an aspect of the invention, an air supply tube provided with an inlet port that takes in air, an outlet port that is arranged opposite a portion of an elongated target structure in a longitudinal direction, to which air taken in from the inlet port is to be supplied, and has an elongated opening shape in parallel to the portion of the target structure in the longitudinal direction and different from the inlet port, the air supply tube including: a channel portion in which a channel space for allowing air to flow between the inlet port and the outlet port is formed, and plural suppressing portions that are provided in different parts in an air flow direction in the channel space of the channel portion and suppress the flow of air, wherein the plural suppressing portions include at least a most downstream suppressing portion that is provided in a most downstream-side part in the air flow direction of the channel portion and is configured such that a channel space in the most downstream-side part is closed by a ventilating member with plural ventilation portions dotted therein, and a first upstream suppressing portion that is provided in a part initially located on the upstream side in the air flow direction relative to the most downstream suppressing portion in the channel portion, and is configured such that a portion of a channel space in the corresponding part is blocked along a direction parallel to the longitudinal direction of the outlet port and a gap in a shape extending in the direction parallel to the longitudinal direction of the outlet port is provided to allow air to pass therethrough, and a gap regulating portion that forms an extended gap at the same interval as the gap extended and connected in a state of being bent in a direction away from the most downstream suppressing portion from the gap of the first upstream suppressing portion is provided in a part between the most downstream suppressing portion and the first upstream suppressing portion in the channel portion.

BRIEF DESCRIPTION OF THE DRAWINGS

Exemplary embodiments of the present invention will be described in detail based on the following figures, wherein:

FIG. 1 is an explanatory view showing the outline of an air supply tube, and an air supply device and an image forming apparatus using the air supply tube according to Exemplary Embodiment 1 or the like;

FIG. 8A is a schematic sectional view of a first bent channel portion and a second bent channel portion of the air supply duct on a magnified scale, and FIG. 8B is a schematic sectional view of the portion of the air supply duct of FIG. 8A taken along the line B-B;

FIG. 10A is an explanatory sectional view showing the configuration and the like of a principal portion of the air supply duct subjected to the test, and FIG. 10B is a graph showing the result of the evaluation test;

FIG. 11A is an explanatory sectional view showing the configuration and the like of a principal portion of the air supply duct, and FIG. 11B is a graph showing the result of the evaluation test;

FIG. 13A is a schematic sectional view showing a first bent channel portion and a second bent channel portion of the air supply duct on a magnified scale, and FIG. 13B is a schematic sectional view of the portion of the air supply duct of FIG. 13A taken along the line B-B;

FIG. 15A is a schematic sectional view of a first bent channel portion and a second bent channel portion of the air supply duct on a magnified scale, and FIG. 15B is a schematic sectional view of the portion of the air supply duct of FIG. 15A taken along the line B-B;

FIG. 20A is an explanatory sectional view showing the configuration and the like of a principal portion of the air supply duct, and FIG. 20B is a graph showing the result of the evaluation test;

FIG. 22A is an explanatory sectional view showing the configuration and the like of a principal portion of the air supply duct, and FIG. 22B is a graph showing the result of the evaluation test.

DETAILED DESCRIPTION

Hereinafter, the mode for carrying out the invention (simply referred to as "exemplary embodiment") will be described with reference to the accompanying drawings.

Exemplary Embodiment 1

Figure 1:
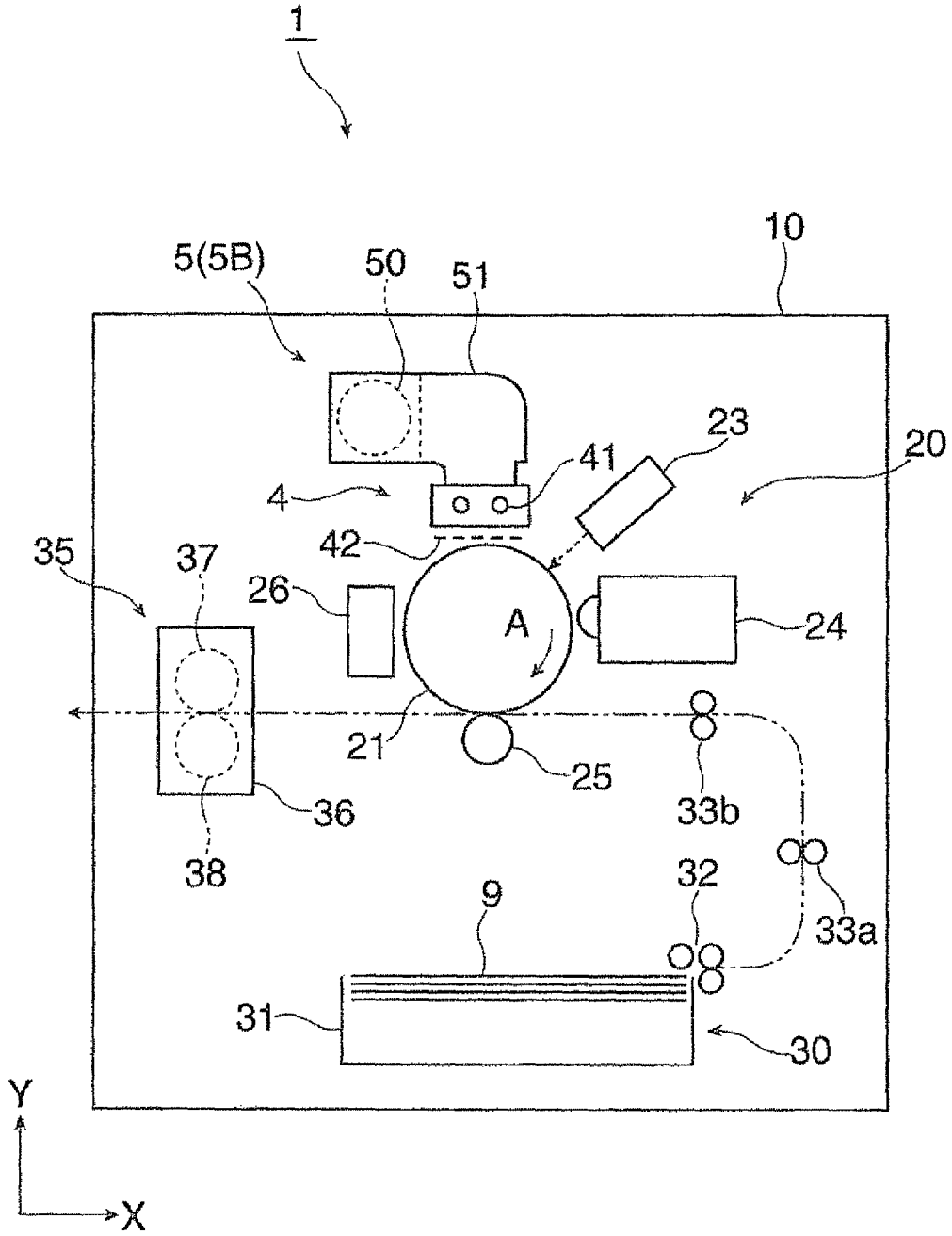
Figure 2:
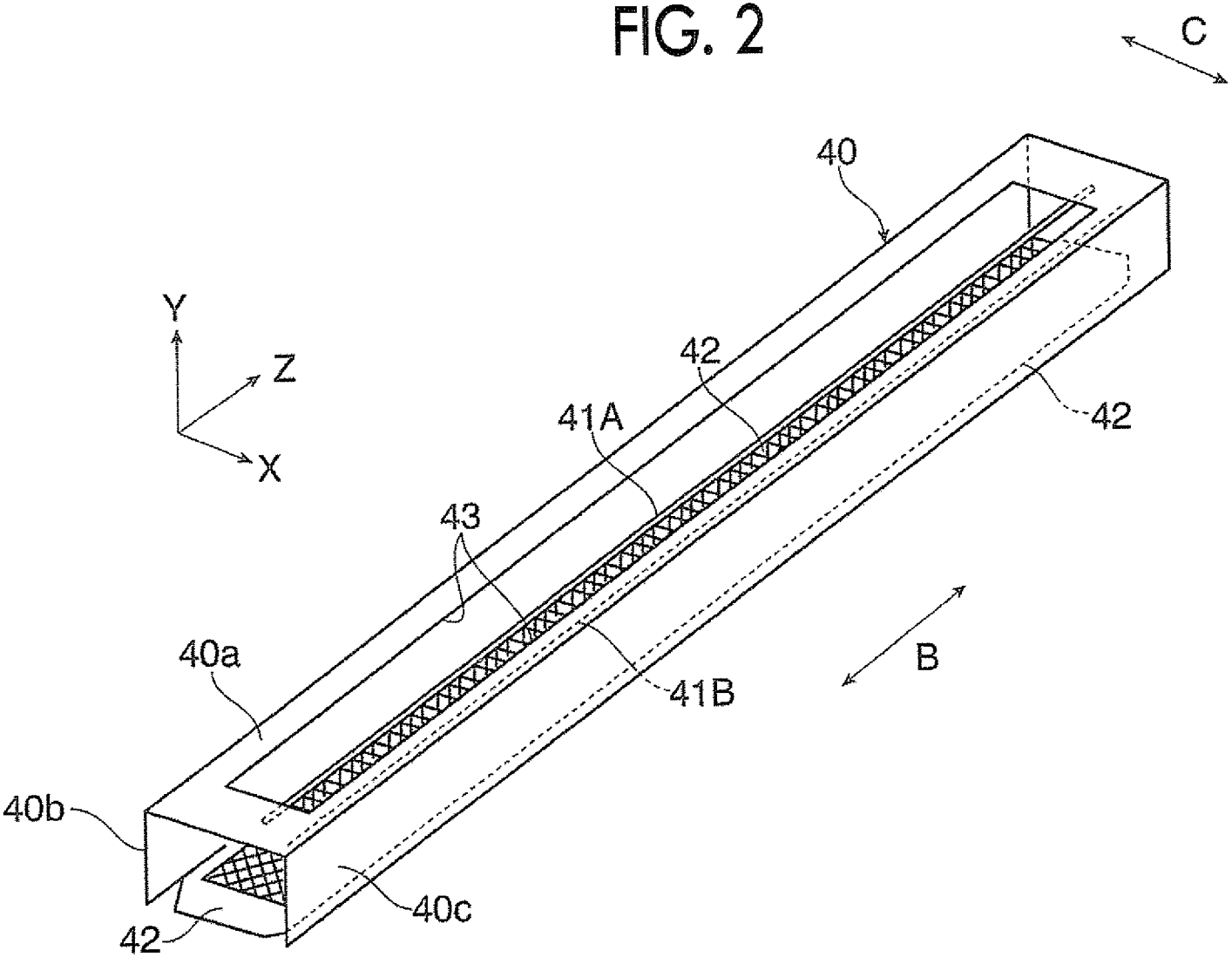
FIG. 2 is a schematic perspective view showing a charging device having a corona discharger in the image forming apparatus of FIG. 1.
Figure 3:
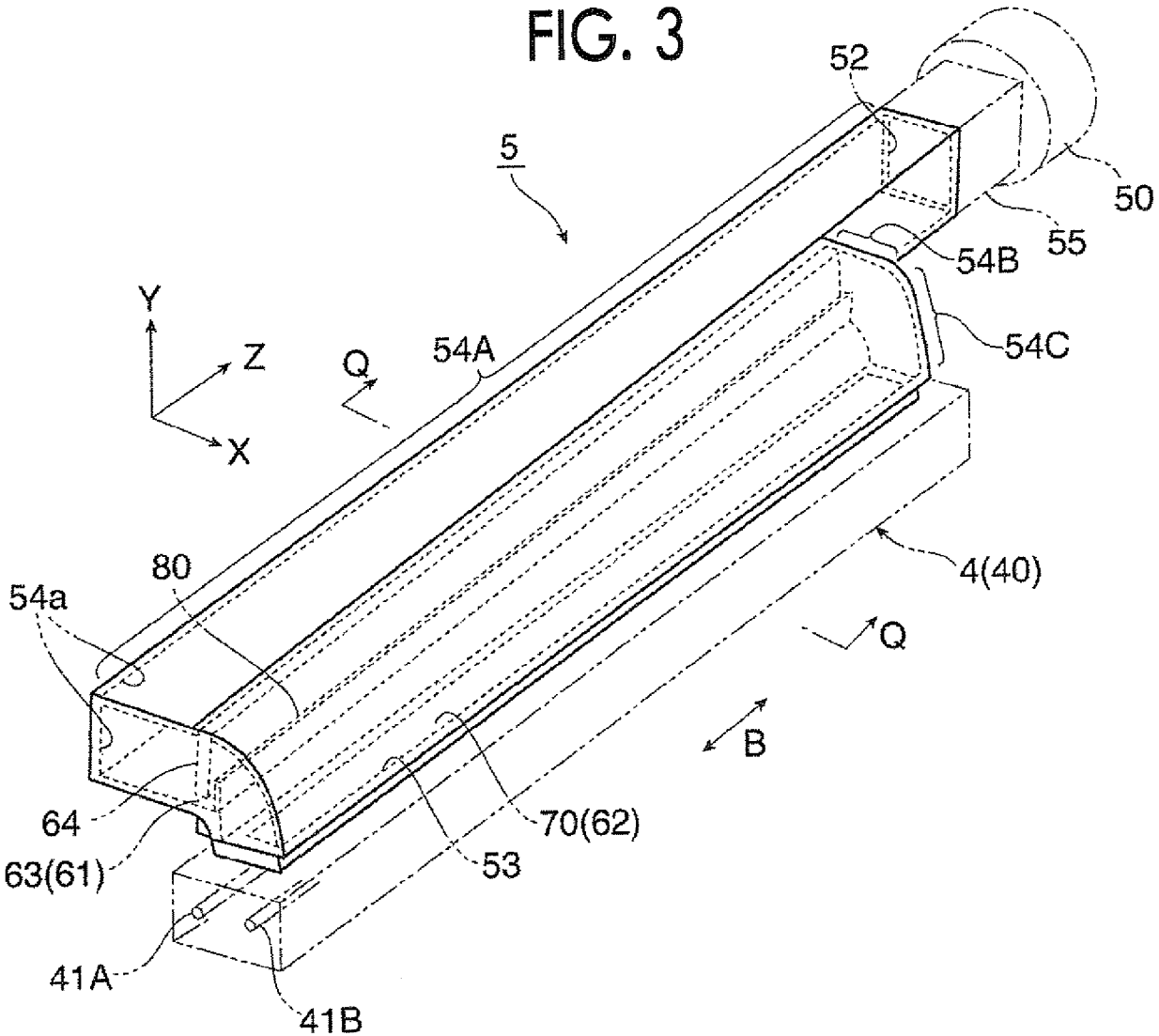
FIG. 3 is a schematic perspective view showing the outline of an air supply tube and an air supply device which are applied to the charging device of FIG. 2.

FIGS. 1 to 3 show an air supply tube according to Exemplary Embodiment 1, and an air supply device and an image forming apparatus using the air supply tube. FIG. 1 shows the outline of the image forming apparatus. FIG. 2 shows a charging device as an elongated target structure which is used in the image forming apparatus and into which air is to be put by the air supply tube or the air supply device. FIG. 3 shows the outline of the air supply tube or the air supply device.

As shown in FIG. 1, an image forming apparatus 1 has, in the internal space of a housing 10 defined by a support frame, an exterior cover, and the like, an imaging unit 20 which forms a toner image made of toner as a developer and transfers the toner image to a sheet 9 as an example of a recording sheet, a sheet feeder 30 which accommodates the sheet 9 to be put into the imaging unit 20 and puts the sheet 9, and a fixing device 35 which fixes the toner image formed by the imaging unit 20 to the sheet 9. Although in Exemplary Embodiment 1, a case where the single imaging unit 20 is provided will be described, plural imaging units may be provided.

The imaging unit 20 uses, for example, the known electrophotographic system. The imaging unit 20 primarily has a photoreceptor drum 21 which is driven to rotate in a direction indicated by arrow A (in the drawing, a clockwise direction), a charging device 4 which charges the peripheral surface of the photoreceptor drum 21 as an image forming region with a suitable potential, an exposure device 23 which irradiates light (dotted line with arrow) onto the charged surface of the photoreceptor drum 21 on the basis of image information (signal) input from the outside to form an electrostatic latent image which has a potential difference, a developing device 24 which develops the electrostatic latent image to a toner image with toner, a transfer device 25 which transfers the toner image to the sheet 9, and a cleaning device 26 which remove toner or the like remaining on the surface of the photoreceptor drum 21 after transfer.

Figure 4:
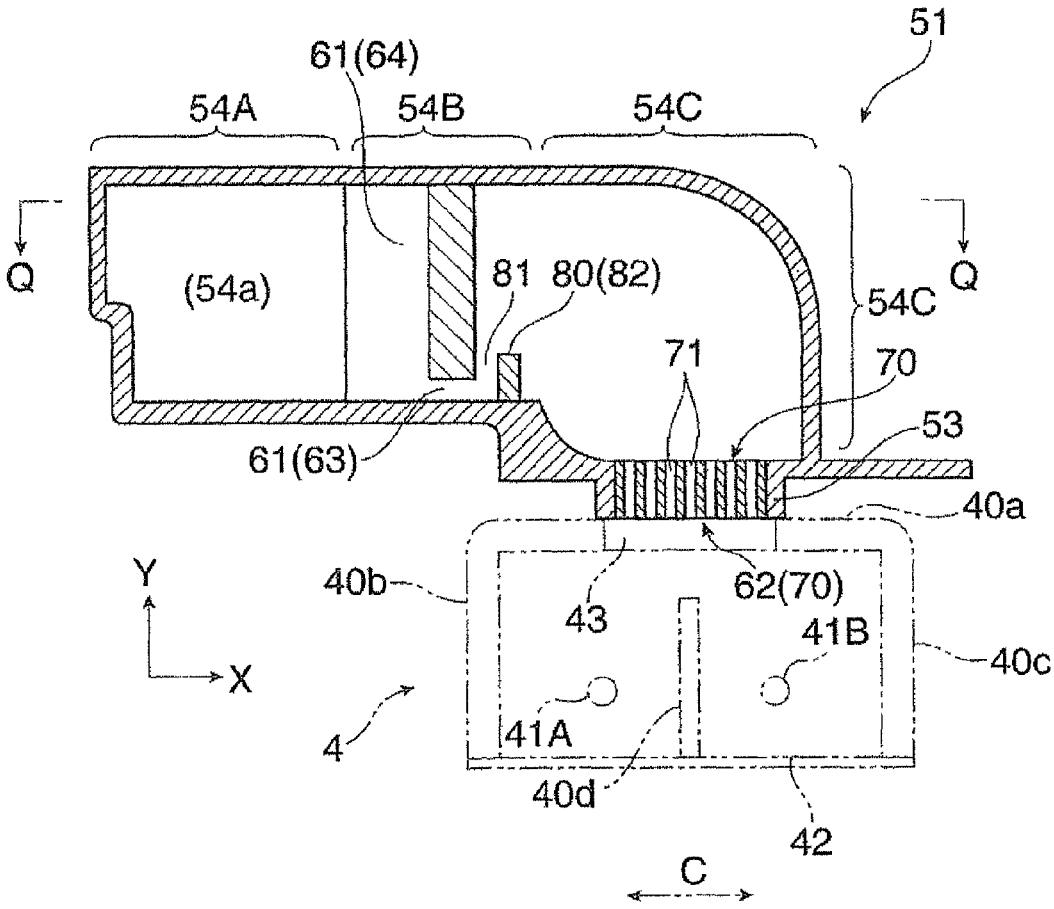
FIG. 4 is a sectional view of the air supply device (air supply duct) of FIG. 3 taken along the line Q-Q.

Of these, as the charging device 4, a corona discharger is used. As shown in FIG. 2 or the like, the charging device 4 having a corona discharger is a so-called scorotron corona discharger which has a shielding case (cover member) 40 having an appearance with a rectangular top plate 40*a* and side plates 40*b* and 40*c* hung downward from the long side portions of the top plate 40*a* extending along a longitudinal direction B, two end support portions (not shown) respectively attached to both end portions (short side portions) in the longitudinal direction B of the shielding case 40, two corona discharge wires 41A and 41B attached between the two end support portions to pass through the internal space of the shielding case 40 and to be substantially linearly stretched, and a grid-like grid electrode (field regulating plate) 42 attached to the lower opening of the shielding case 40 to cover the lower opening between the corona discharge wire 41 and the peripheral surface of the photoreceptor drum 21. Reference numeral 40*d* shown in FIG. 4 and the like denotes a partition wall which partitions a space where the two corona discharge wires 41A and 41B are arranged.

In the charging device 4, the two corona discharge wires 41A and 41B are provided opposite the peripheral surface of the photoreceptor drum 21 at a suitable interval (for example, a discharge gap) gap at least in a region, in which an image is to be formed, along the direction of the rotating axis of the photoreceptor drum 21. In the charging device 4, at the time of image formation, a voltage for charging is applied from a power supply device (not shown) to the discharge wires 41A and 41B (between the discharge wires 41A and 41B and the photoreceptor drum 21).

With use of the charging device 4, substances (unwanted substances), such as paper dust of the sheet 9, corona products which are generated by corona discharge, or external additives of toner, are attached to the corona discharge wires 41 or the grid electrode 42, and the corona discharge wire 41 or the grid electrode 42 is contaminated. Accordingly, corona discharge is not sufficiently or uniformly performed, causing the occurrence of defective charging, such as irregular charging. For this reason, the charging device 4 is also provided with an air supply device 5 which puts air into the discharge wires 41 and the grid electrode 42 to prevent or suppress attachment of unwanted substance to the discharge wires 41 and the grid electrode 42. An opening 43 is formed in an upper surface 40*a* of the shielding case 40 of the charging device 4 to take in air from the air supply device 5. The opening 43 is formed in a rectangular shape. The details of the air supply device 5 will be described below.

The sheet feeder 30 includes a tray-type or cassette-type sheet accommodating member 31 which accommodates plural sheets 9 of a suitable size, type, or the like for use in image formation in a stacked manner, and a sending device 32 which sends the sheets 9 accommodated in the sheet accommodating member 31 toward a transport path one by one. If a sheet feed time comes, the sheets 9 are sent one by one. The plural sheet accommodating members 31 are provided depending on the use mode. A one-dot-chain line with arrow in FIG. 1 indicates a transport path through which the sheet 9 is principally transported. The sheet transport path is formed by plural pairs of sheet transport rollers 33*a* and 33*b*, a transport guide member (not shown), and the like.

Inside the housing 36 formed by an introduction port and a discharge port, through which the sheet 9 passes, the fixing device 35 includes a roller-type or belt-type heating rotating member 37 whose surface temperature is heated and maintained at a suitable temperature by a heating unit and a roller-type or belt-type pressing rotating member 38 which undergoes driven rotation in contact with the heating rotating member 37 at a suitable pressure substantially in the axial direction. The fixing device 35 performs fixing by introducing the sheet 9 after a toner image has been transferred to a contact portion (fixing processing portion) formed when the heating rotating member 37 and the pressing rotating member 38 are in contact with each other and allowing the sheet 9 to pass through the contact portion.

Image formation by the image forming apparatus 1 is performed as follows. Herein, a basic image forming operation when an image is formed on one surface of the sheet 9 will be described.

In the image forming apparatus 1, if the control device or the like receives a command to start an image forming operation, in the imaging unit 20, the peripheral surface of the photoreceptor drum 21 which starts to rotate is charged with a predetermined polarity and potential by the charging device 4. At this time, in the charging device 4, the voltage for charging is applied to the two corona discharge wires 41A and 41B and corona discharge is generated in a state where an electric field is formed between each of the discharge wires 41A and 41B and the peripheral surface of the photoreceptor drum 21, such that the peripheral surface of the photoreceptor drum 21 is charged with a suitable potential. At this time, the charge potential of the photoreceptor drum 21 is regulated by the grid electrode 42.

Subsequently, the charged peripheral surface of the photoreceptor drum 21 is exposed by the exposure device 23 on the basis of image information, such that an electrostatic latent image is formed with a suitable potential difference. Thereafter, when passing through the developing device 24, the electrostatic latent image formed on the photoreceptor drum 21 is developed by toner which is supplied from a developing roller 24*a* and charged with a suitable polarity, and visualized as a toner image.

Next, if transported to a transfer position opposite the transfer device 25 by rotation of the photoreceptor drum 21, the toner image formed on the photoreceptor drum 21 is transferred to the sheet 9 put from the sheet feeder 30 through the transport path at that timing by the transfer device 25. The peripheral surface of each photoreceptor drum 21 after transfer is cleaned by the cleaning device 26.

Subsequently, the sheet 9 to which the toner image is transferred in the imaging unit 2 is transported to be separated from the photoreceptor drum 21 and then put into the fixing device 35, and heated under a pressure when passing through the contact portion of the heating rotating member 37 and the pressing rotating member 38 in the fixing device 35. Thus, the toner image is molten and fixed to the sheet 9. The sheet 9 after the fixing has ended is discharged from the fixing device 35 and transported and accommodated to a discharged sheet accommodating portion (not shown) or the like formed outside the housing 10.

In this way, a monochrome image with toner of one color is formed on one surface of one sheet 9, and the basic image forming operation ends. When there is an instruction of an image forming operation for plural sheets, the sequence of operations described above is repeated in a similar way by the number of sheets.

Next, the air supply device 5 will be described.

As shown in FIG. 1 or 3, the air supply device 5 includes an air supply 50 which has a rotating fan sending air, and an air supply duct 51 which takes in air sent from the air supply 50, and guides and ejects air to the charging device 4 to which air is to be supplied.

As an air supply 50, for example, a radial-flow air supply fan is used. The air supply 50 is driven and controlled to send a suitable volume of air. As shown in FIGS. 3 to 6, the air supply duct 51 has an inlet port 52 which takes in air sent from the air supply 50, an outlet port 53 which is arranged opposite a portion (the upper surface 40*a* of the shielding case 40) of the elongated charging device 4 in the longitudinal direction B, to which air taken in from the inlet port 52 is to be supplied, and outputs air to flow in a direction perpendicular to the longitudinal direction B, and a channel portion 54 in which a channel space 54*a* for allowing air to flow between the inlet port 52 and the outlet port 53 is formed.

In the channel portion 54 of the air supply duct 51, one end portion is opened with the inlet port 52, and the other end portion is closed. As a whole, the channel portion 54 has a rectangular tube-shaped introduction channel portion 54A which is formed to extend along the longitudinal direction B of the charging device 4, a rectangular tube-shaped first bent channel portion 54B which is formed to be substantially bent at a right angle and extend in a horizontal direction (a direction substantially parallel to the coordinate axis X) with an increasing width of the channel space from a part close to the other end portion of the introduction channel portion 54A, and a second bent channel portion 54C which is formed to be finally bent and extend in a vertical direction (a direction substantially parallel to the coordinate axis Y) downward close to the charging device 4 with the same width of the channel space from one end portion of the first bent channel portion 54B. In the termination portion of the second bent channel portion 54C, the outlet port 53 is formed to have an opening shape slightly smaller than the sectional shape of the channel space of the termination portion (the length of the rectangle in the longitudinal direction is substantially equal). In the first bent channel portion 54B and the second bent channel portion 54C, the width (the dimension in the longitudinal direction B) of the channel space 54*a* is substantially equal.

The inlet port 52 of the air supply duct 51 is formed to substantially have a square opening shape. A connection duct 55 which connects the air supply 50 and the inlet port 52 to send air from the air supply 50 to the inlet port 52 of the air supply duct 51 is attached to the inlet port 52 (FIG. 3). The outlet port 53 of the air supply duct 51 is formed so that the opening shape of the outlet port 53 has an elongated shape (for example, a rectangular shape) parallel to the portion of the charging device 4 in the longitudinal direction B. For this reason, the air supply duct 51 has the relation that the inlet port 52 and the outlet port 53 have different opening shapes. Even if the inlet port 52 and the outlet port 53 have the same shape, when the opening area is different (an analogous shape), this is included in the relation that the opening shape is different.

As described above, in the air supply duct 51 in which the inlet port 52 and the outlet port 53 are formed in different opening shapes, there is a portion in which the sectional shape of the channel space 54*a* changes halfway in the channel portion between the inlet port 52 and the outlet port 53. Incidentally, in the air supply duct 51, the sectional shape of the channel space 54*a* substantially having a square shape in the introduction channel portion 54A is changed to the sectional shape of the channel space 54*a* having a rectangular shape widened only in the horizontal direction (the height is not changed) in the first bent channel portion 54B. In other words, the sectional shape of the channel space 54*a* in the introduction channel portion 54A becomes the sectional shape of the channel space 54*a* rapidly widened in the first bent channel portion 54B.

In the air supply duct 51 having a portion in which the sectional shape of the channel space 54*a* is changed, disturbance, such as separation or swirl, occurs in the flow of air in the portion in which the sectional shape is changed. For this reason, even when air is taken in from the inlet port 52 at a uniform air speed, air output from the outlet port 53 has a tendency to be ununiform. The tendency that the air speed of air output from the outlet port is finally ununiform occurs substantially in a similar way even when the air flow (travel) direction in the air supply duct 51 is changed, regardless of the presence/absence of a change in the sectional shape in the channel space 54*a*.

Figure 19A:
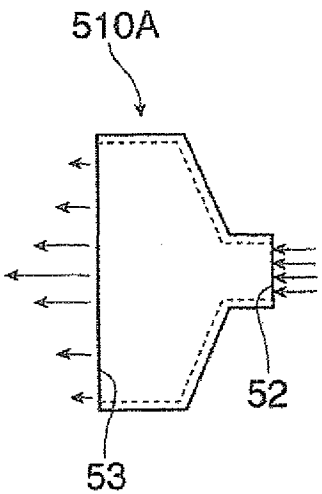
FIGS. 19A to 19D are explanatory top views showing various modifications of an air supply duct.
Figure 19B:
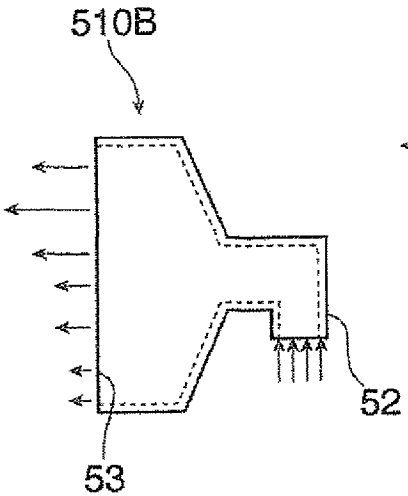
Figure 19C:
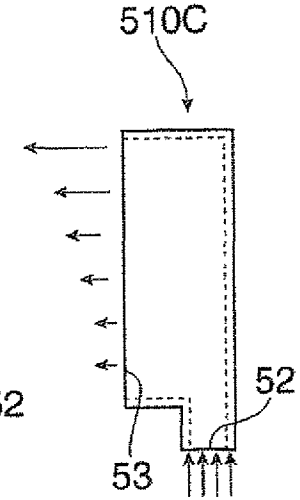
Figure 19D:
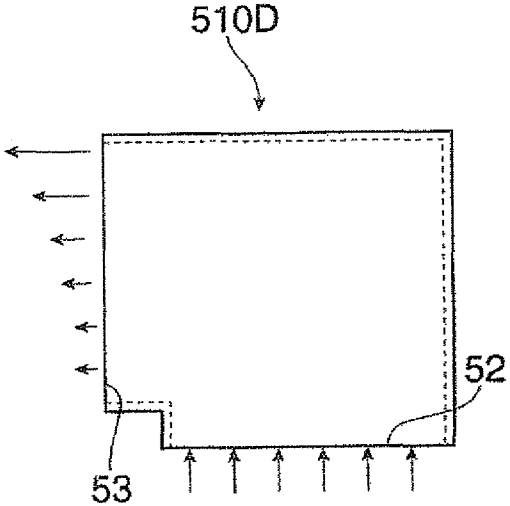

FIGS. 19A to 19C show representative examples 510A to 510C of the air supply duct in which the inlet port 52 and the outlet port 53 are formed in different opening shapes. In the drawings, the states of the air speed of air taken in to the inlet port 52 and the air speed of air output from the outlet port 53 in each duct 510 are represented by the length of the arrows. FIGS. 19A to 19D show a state where each air supply duct 510 is viewed from above. In the drawings, when the arrows are equal in length, this represents that the air speed is equal. When the arrows are different in length, this represents that the air speed is different. In the drawings, a dotted line represents (the sidewalls forming) the channel space of each duct. Incidentally, in the air supply ducts 510B and 510C, a configuration is made in which the air flow direction is changed halfway and at least one of the sectional shape and area of the channel space is changed. In the air supply duct 510D shown in FIG. 19D, a configuration is made in which the inlet port 52 and the outlet port 53 are formed to have the same opening shape (and the same opening area), and only the ventilation direction is changed halfway.

Accordingly, as shown in FIGS. 3 to 6, in the air supply duct 51 of the air supply device 5, two suppressing portions 61 and 62 are provided in different parts in the air flow direction (the direction of arrow represented by reference numeral E) of the channel space 54*a* of the channel portion 54 to suppress the flow of air. Of the two suppressing portions, the suppressing portion 62 is a most downstream suppressing portion which is provided in a most downstream-side part in the air flow direction of the channel space 54*a* of the channel portion 54, and the suppressing portion 61 is a first upstream suppressing portion which is provided at a sit initially located on the upstream side in the air flow direction from the most downstream suppressing portion 62 in the channel space 54*a* of the channel portion 54.

The first upstream suppressing portion 61 is provided substantially at an intermediate position in the air flow direction in the channel space 54*a* of the first bent channel portion 54B. The first upstream suppressing portion 61 blocks a portion of the channel space 54*a* in a direction parallel to the longitudinal direction (the same direction as the longitudinal direction B of the charging device 4) of the opening shape of the outlet port 53, and has a gap 63 extending in the longitudinal direction of the opening shape of the outlet port 53.

In the first upstream suppressing portion 61 of Exemplary Embodiment 1, a plate-shaped partition member 64 is provided in the channel space 54*a* of the bent channel portion 54B without changing the exterior of the first bent channel portion 548. Specifically, the partition member 64 has a structure in which the upper space portion in the channel space 54*a* of the first bent channel portion 548 is closed, a lower end portion 64*a* of the partition member is arranged at a suitable interval H with respect to the bottom portion (inner wall) of the channel space 54*a*, and a gap 63 is provided in the lower portion of the channel space 54*a*. The partition member 64 is formed of the same material as the duct 51 through integral molding or a material different from the duct 51.

Figure 8A:
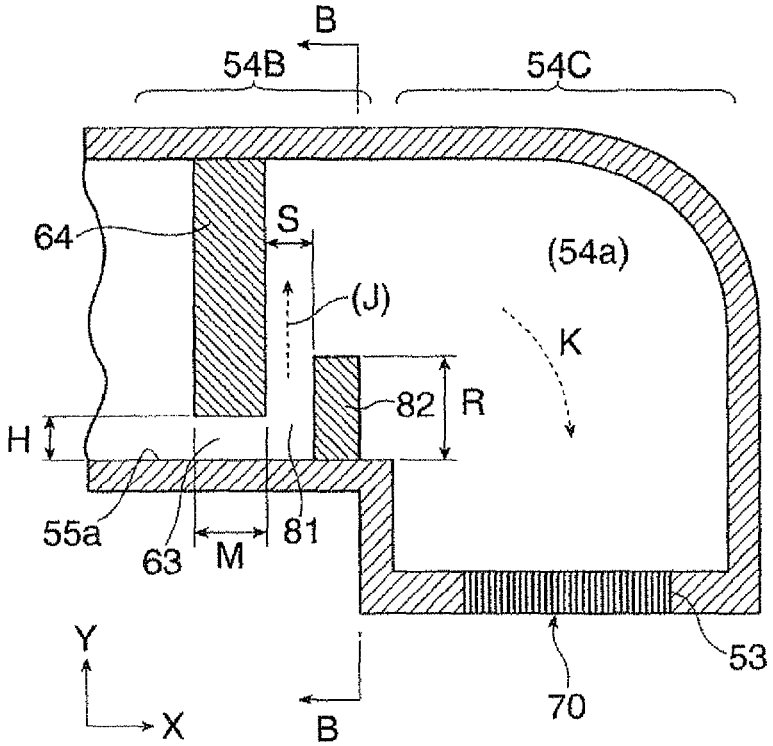
FIGS. 8A and 8B show a portion (a first upstream suppressing portion, a gap regulating portion, and the like) of the air supply duct of FIG. 4, specifically.
Figure 8B:
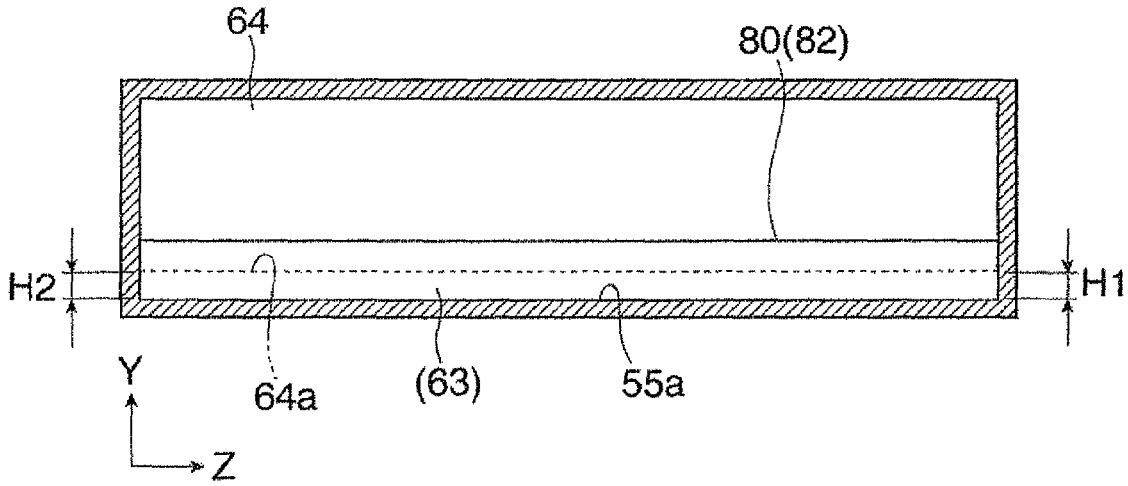

The height H of the gap 63, the path length M, and the width (the length in the longitudinal direction) W are selected and set from the viewpoint that the air speed of air flowing from the introduction channel portion 54A to the first bent channel portion 54B is as uniform as possible, and are set taking into consideration the dimension (capacity) of the duct 51, the flow rate per unit time of air which should flow to the duct 51 or the charging device 4, or the like. For example, the height H of the gap 63 is not limited to when the dimension is equal in the width direction, and may be set to dimension which is changed evenly or partially from the above-described viewpoint. FIG. 8B shows a configuration in which, in regard to the height H of the gap 63, the height H1 in the end portion close to the inlet port is substantially equal to the height H2 in the end portion away from the inlet port (that is, when the dimension is equal in the width direction of the gap 63).

The most downstream suppressing portion 62 is formed such that the channel space (opening) at the termination (outlet port 53) of the second bent channel portion 54C is closed by a ventilating member 70 having plural ventilating portions 71.

Figure 6:
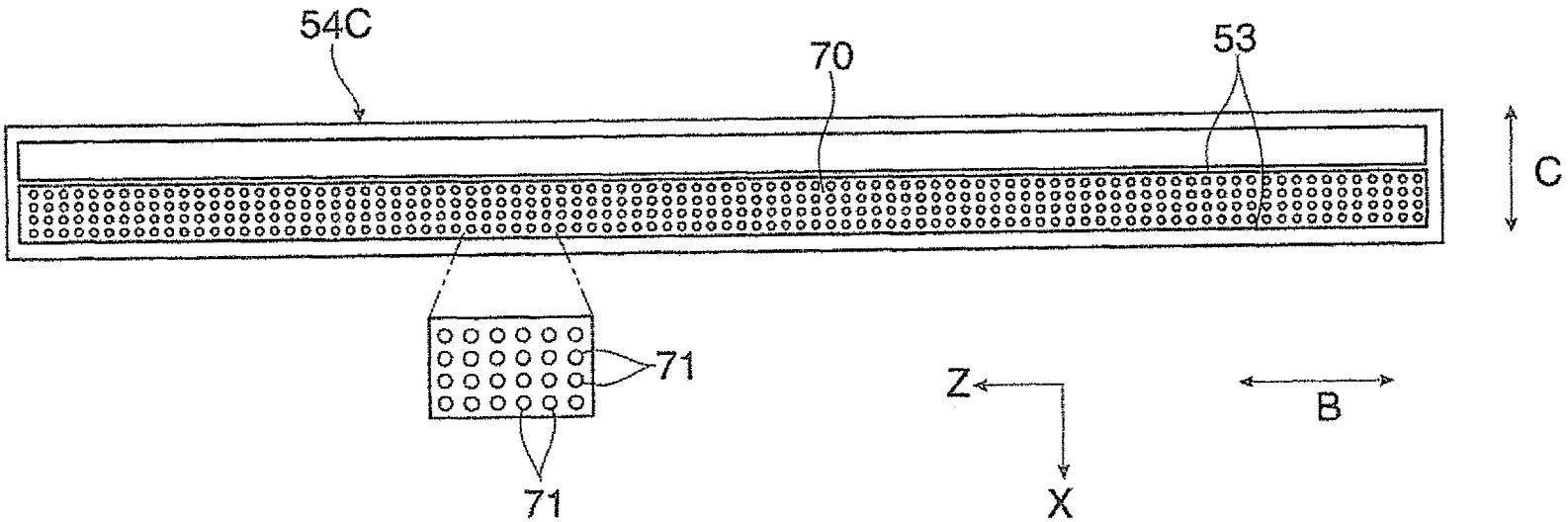
FIG. 6 is a diagram showing a state where the air supply device of FIG. 3 is viewed from below (outlet port side)
Figure 7:
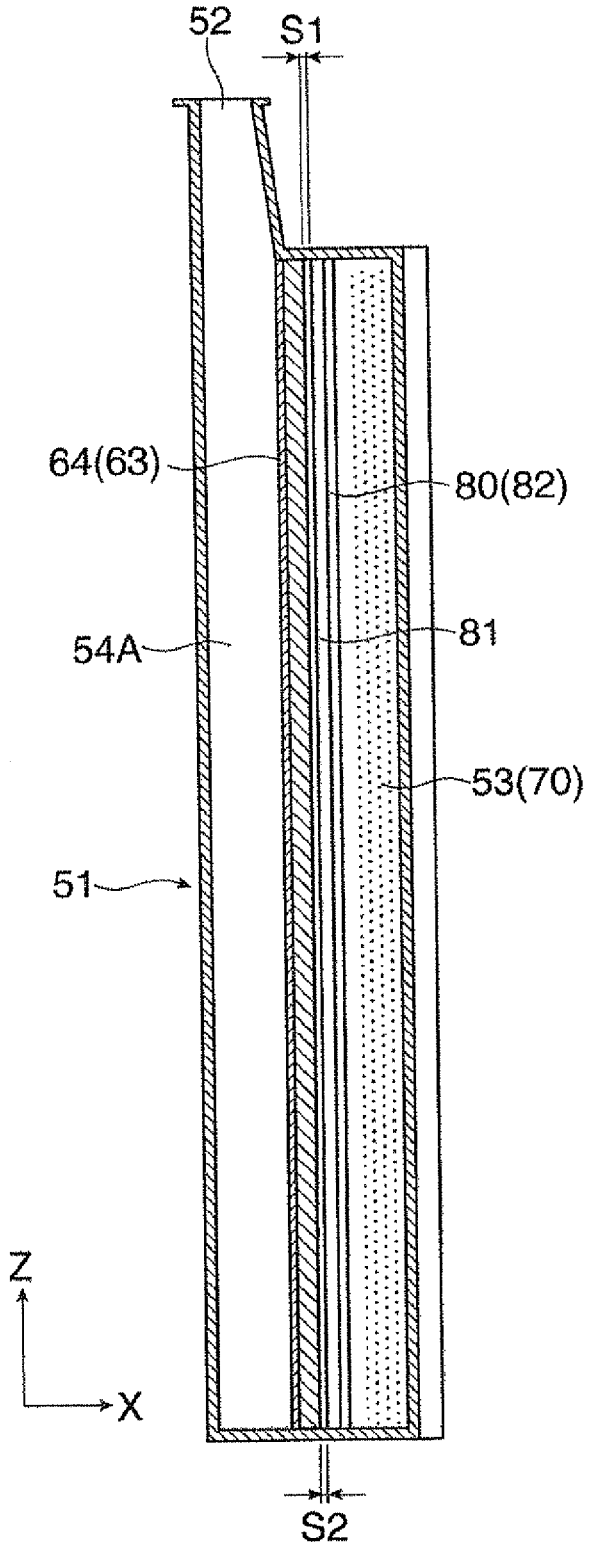
FIG. 7 is a sectional view of the air supply duct of FIG. 4 taken along the line Q-Q.

As schematically shown in FIG. 6, plural ventilating portions 71 are through holes which substantially have a circular opening shape and extend to linearly pass through the ventilating member. The plural ventilating portions 71 are arranged in plural (for example, four or more) columns at regular intervals along the longitudinal direction (B) of the opening shape of the outlet port 53 and at the same intervals as the regular intervals in a transverse direction C perpendicular to the longitudinal direction. Accordingly, the plural ventilating portions 71 are formed to be dotted over the entire region of the channel space at the termination of the second bent channel portion 54C or the opening shape of the outlet port 53. For this reason, the ventilating member 70 of Exemplary Embodiment 1 is a perforated plate in which the plural ventilating portions (holes) 71 are formed to be dotted in a plate-shaped member. Although it is preferable that the plural ventilating portions 71 are formed to be substantially evenly dotted (substantially at a given density) in the opening region of the outlet port 53, the plural ventilating portions 71 may be provided slightly densely unless air output from the outlet port 53 becomes irregular.

The ventilating member 70 is formed of the same material as the duct 51 through integral molding or a material different from the duct 51, and is mounted at the outlet port 53. The opening shape, the opening dimension, the hole length, and the density of the ventilating portions (holes) 71 are selected and set from the viewpoint that the air speed of air flowing from the second bent channel portion 54C through the outlet port 53 is as uniform as possible, and are set taking into consideration the dimension (capacity) of the duct 51, the flow rate per unit time of air which should flow to the duct 51 or the charging device 4, or the like.

In the air supply duct 51 of the air supply device 5, even if a large volume of air is put from the inlet port 52 (for example, the volume is equal to or greater than 0.3 $m^3$/second), air from the outlet port 53 is output with reduced irregularity in the air speed in both directions corresponding the longitudinal direction (the same direction as the longitudinal direction B of the charging device 4) and the transverse direction perpendicular to the longitudinal direction in the opening shape of the outlet port 53. For this reason, as shown in FIGS. 4, 5, 7, and 8, a gap regulating portion 80 is provided in a part between the two suppressing portions 61 and 62 in the channel space 54*a*.

That is, only if the two suppressing portions 61 and 62 are provided in the air supply duct 51 (see FIG. 20A), as described below in detail, when a large volume of air is put from the inlet port 52, air from the outlet port 53 tends to be not output with reduced irregularity in the air speed in both directions corresponding to the longitudinal direction and the transverse direction perpendicular to the longitudinal direction in the opening shape of the outlet port 53 (see FIG. 215). For this reason, the gap regulating portion 80 becomes means for reducing irregularity in the air speed in both directions.

The gap regulating portion 80 forms an extended gap 81 at the same interval S as the interval (height H) of the gap 63 extended and connected in a state of being bent in a direction J away from the most downstream suppressing portion 62 from the gap 63 in the first upstream suppressing portion 61 in a part between the most downstream suppressing portion 62 and the first upstream suppressing portion 61 in the first bent channel portion 54B. The direction J away from the most downstream suppressing portion 61 is the direction in which the distance from the most downstream suppressing portion 62 is maintained in the same state or the direction in which the distance keep increasing.

The gap regulating portion 80 of Exemplary Embodiment 1 is provided by arranging a plate-shaped member 82 to be erect substantially opposite and in parallel to the first upstream suppressing portion 61 at a suitable interval (S) in a part on the downstream side in an air flow direction E from the first upstream suppressing portion 61 in an inner wall portion 55*a* on the inner side of the first bent channel portion 54B in a bending direction K. That is, the plate-shaped member 82 is arranged in a state where an interval S1 in the end portion close to the inlet port relative to the partition member 64 of the first upstream suppressing portion 61 is substantially equal to an interval S2 in the opposing end portion.

Accordingly, the extended gap 81 which is connected to the gap 63 is formed between the gap regulating portion 80 and the first upstream suppressing portion 61. When regarded as a single gap along with the gap 63 of the first upstream suppressing portion 61, the extended gap 81 is configured such that the sectional shape in the air flow direction E is an L shape. In the gap regulating portion 80, the height of the plate-shaped member 82 is set such that the path length R of the extended gap 81 is substantially equal to the path length M of the gap 63. The regulating portion 80 of the plate-shaped member 82 is formed of the same material as the duct 51 through integral molding or a material different from the duct 51.

Hereinafter, the operation of the air supply device 5 will be described.

At the time of drive setting, such as an image forming operation, in the air supply device 5, the air supply 50 is driven to rotate and sends a suitable volume of air. Air (E) sent from the air supply 50 having started is taken in from the inlet port 52 of the air supply duct 51 to the channel space 54*a* of the channel portion 54 through the connection duct 55.

Figure 5:
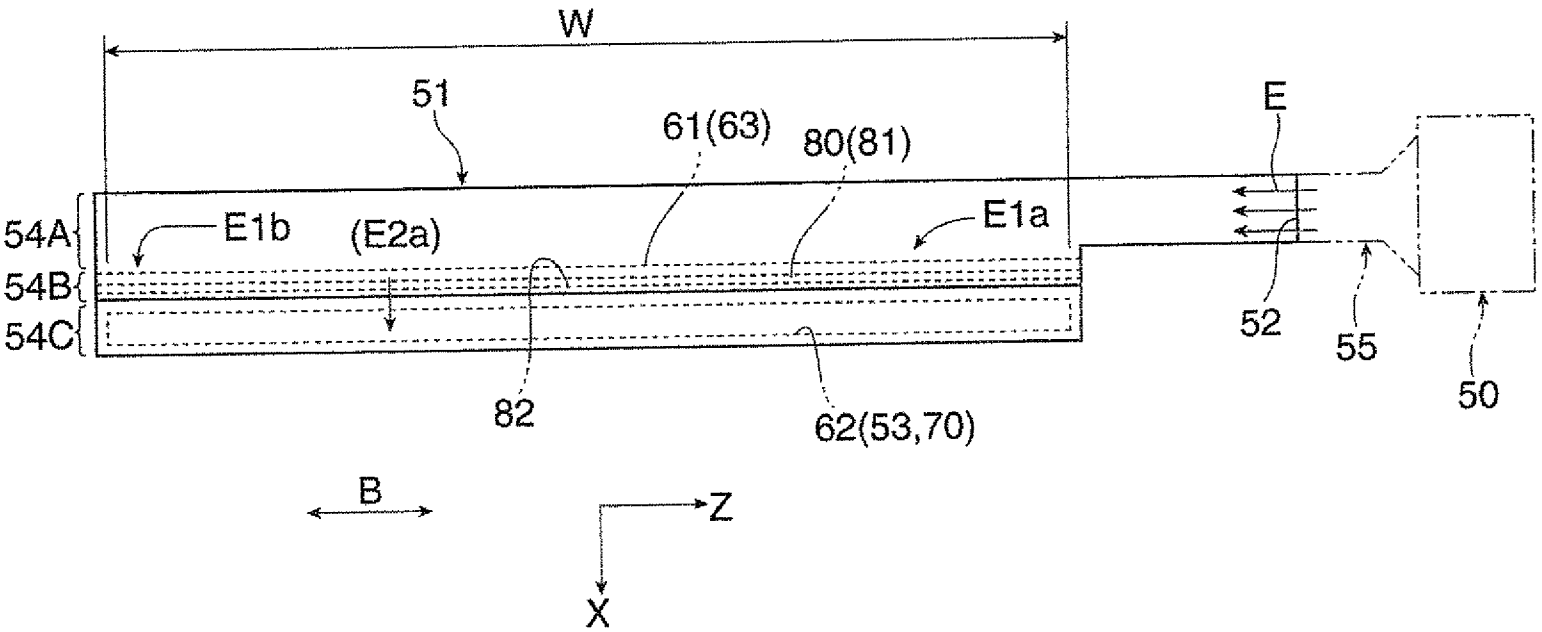
FIG. 5 is a schematic view showing a state where the air supply device of FIG. 3 is viewed from above.
Figure 9:
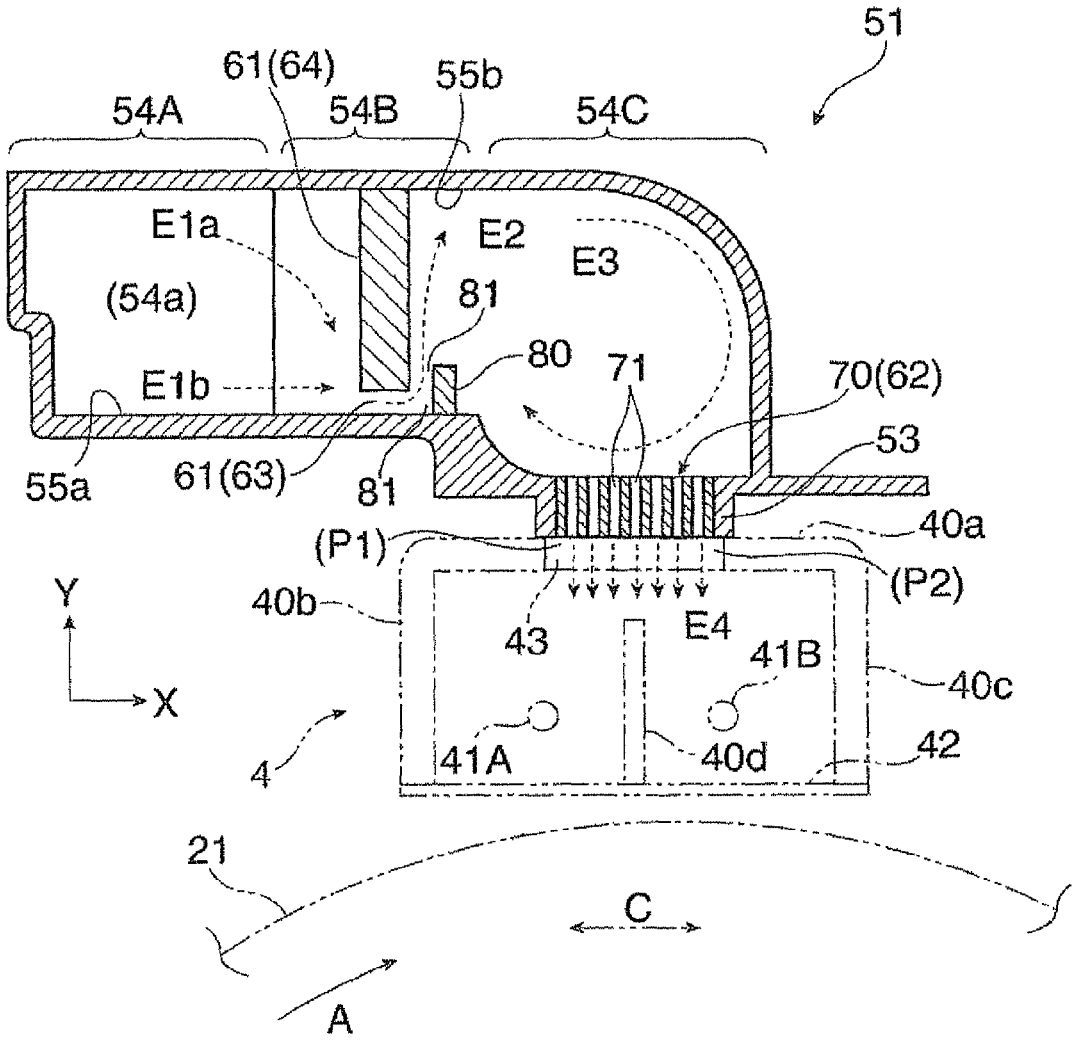
FIG. 9 is an explanatory view showing the operation state and the like of the air supply device of FIG. 3.

Subsequently, as shown in FIG. 5 or 9, air (E) taken in to the air supply duct 51 is sent to flow into the channel space 54*a* of the first bent channel portion 54B through the channel space 54*a* of the introduction channel portion 54A (see dotted-line arrows E1*a* and E1*b* of FIG. 5, or the like). Air (E1) sent to the first bent channel portion 54B passes through the gap 63 of the first upstream suppressing portion 61 and travels in a state where the travel direction (air flow direction) is substantially changed to a direction at a right angle.

At this time, in regard to air (E2) when passing through the gap 63 of the first upstream suppressing portion 61, the flow is suppressed by the gap 63 of the first upstream suppressing portion 61 (in a state where a pressure is increased), and air flows out from the gap 63 in a uniform state. In regard to air (E2) when flowing into the channel space 54*a* of the first bent channel portion 54B, the direction when flowing out from the gap 63 of the suppressing portion 61 is substantially uniformized in a direction perpendicular to the longitudinal direction (B) of the outlet port 53.

Next, as indicated by dotted-line arrow E2, air (E2) after passing through the gap 63 of the first upstream suppressing portion 61 continuously passes through the extended gap 81 in the gap regulating portion 80 and travels to flow into the channel space 54*a* of the second bent channel portion 54C.

At this time, in regard to air (E2) when passing through the extended gap 81 in the gap regulating portion 80, the flow is continuously suppressed by the extended gap 81 (in a state where a pressure is increased), and air is induced by the extended gap 81 and travels to flow in the direction (J) toward an inner wall portion 55*b* on the upstream side of the first bent channel portion 54B farther away from the most downstream suppressing portion 62 (outlet port 53). Finally, air flows from the extended gap 81 into the channel space 54*a* of the second bent channel portion 54C in a uniform state.

Subsequently, as indicated by dotted-line arrow E3, air (E3) flowing into the channel space 54*a* of the second bent channel portion 540 flows into the channel space 54*a* of the introduction channel portion 54A or the channel space 54*a* of the second bent channel portion 54C having capacity greater than the space of the gap 63 and the extended gap 81, and is retained to rotate in the channel space 54*a* of the second bent channel portion 540. Thus, irregularity in the air speed is reduced.

Finally, as shown in FIG. 9, air (E3) which flows into and is retained in the second bent channel portion 540 passes through the plural ventilating portions (holes) 71 in the ventilating member 70 which forms the most downstream suppressing portion 62 provided at the termination of the bent channel portion 54C or the outlet port 53, and is thus supplied from the outlet port 53 in a state where the travel direction is changed (see the direction, length, or the like of dotted-line arrow E4 of FIG. 9).

At this time, air (E4) which is supplied from the outlet port 53 passes through the plural ventilating portions 71 of the ventilating member 70 relatively narrower than the opening area of the outlet port 53 and is sent in a state where the flow is suppressed (at the time, in a state where a pressure is increased). Air (E4) which is supplied from the outlet port 53 are dotted over the entire opening region of the outlet port 53 and passes through the plural ventilating portions 71 formed under the same condition, and is sent from the outlet port 53 in a uniform state to correspond to the surface of a region substantially close to the opening shape of the outlet port 53. Air (E4) which is supplied from the outlet port 53 is sent in a state where the travel direction is changed to the direction substantially perpendicular to the longitudinal direction of the outlet port 53.

In this way, air (E4) output from each of the plural ventilating portions 71 of the ventilating member 70 is sent in a state where the travel direction becomes the direction substantially perpendicular to the longitudinal direction of the outlet port 53, and the air speed is substantially uniformized. The air speed of air (E4) output from the outlet port 53 is substantially uniformized in the longitudinal direction (B) of the opening shape (rectangular shape) of the outlet port 53, and is also substantially uniformized in the transverse direction C.

As shown in FIG. 9, air (E4) which is sent from the outlet port 53 of the air supply duct 51 is supplied to the case 40 through the opening 43 formed in the upper surface 40*a* of the shielding case 40 of the charging device 4, and is supplied to the two corona discharge wires 41A and 41B arranged in the space divided by the partition wall 40*d* at the internal center of the case 40 and the grid electrode 42 attached to be in the lower opening of the case 40. At this time, air which is supplied to the corona discharge wires 41A and 41B and the grid electrode 42 is output from the outlet port 53 at a substantially uniform air speed in both the longitudinal direction and the transverse direction of the outlet port 53 of the supply duct 51. Thus, air is substantially equally supplied to the two discharge wires 41A and 41B and the grid electrode 42.

Accordingly, it is possible to avoid unwanted substances, such as paper dust, external additives of toner, or corona products, which will be attached to the two discharge wires 41A and 41B and the grid electrode 42. As a result, it is possible to prevent deterioration, such as irregularity or the like in charge performance, because unwanted substances are sparsely attached to the discharge wires 41A and 41B or the grid electrode 42 in the charging device 4, making it possible to charge the peripheral surface of the photoreceptor drum 21 uniformly (uniformly in both the axial direction and the peripheral direction in the rotation direction A). A toner image which is formed by the imaging unit 20 having the charging device 4 or an image which is finally formed on the sheet 9 is obtained as a satisfactory image in which defective image quality (density irregularity or the like) due to defective charging, such as charge irregularity, is reduced.

Figure 10A:
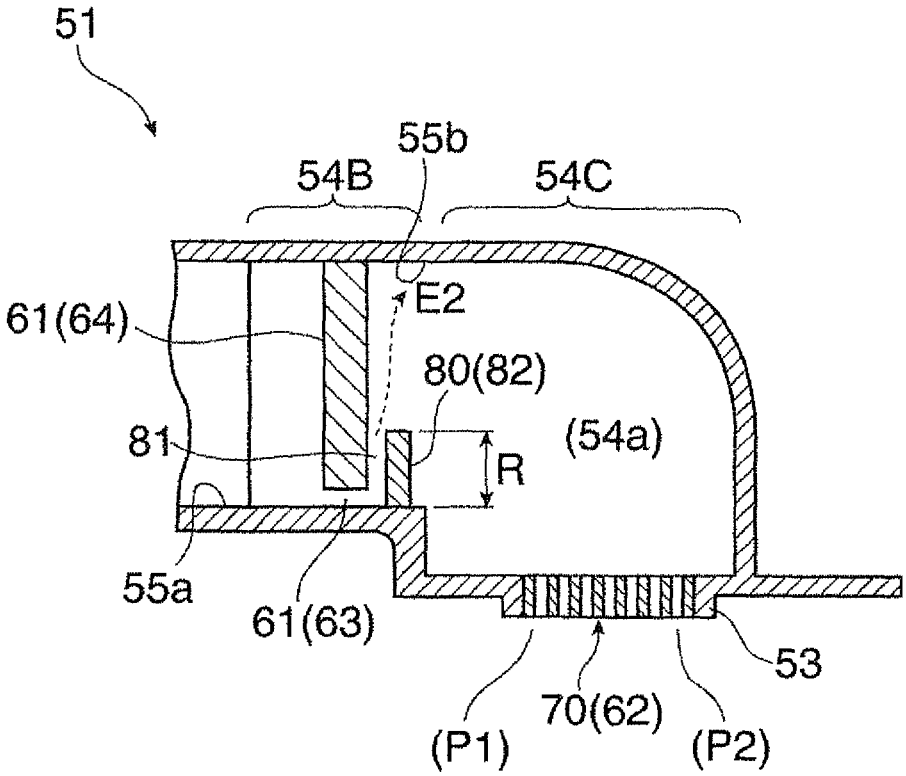
FIGS. 10A and 10B show an evaluation test relating to the performance characteristics of the air supply duct of FIG. 4, specifically.
Figure 10B:
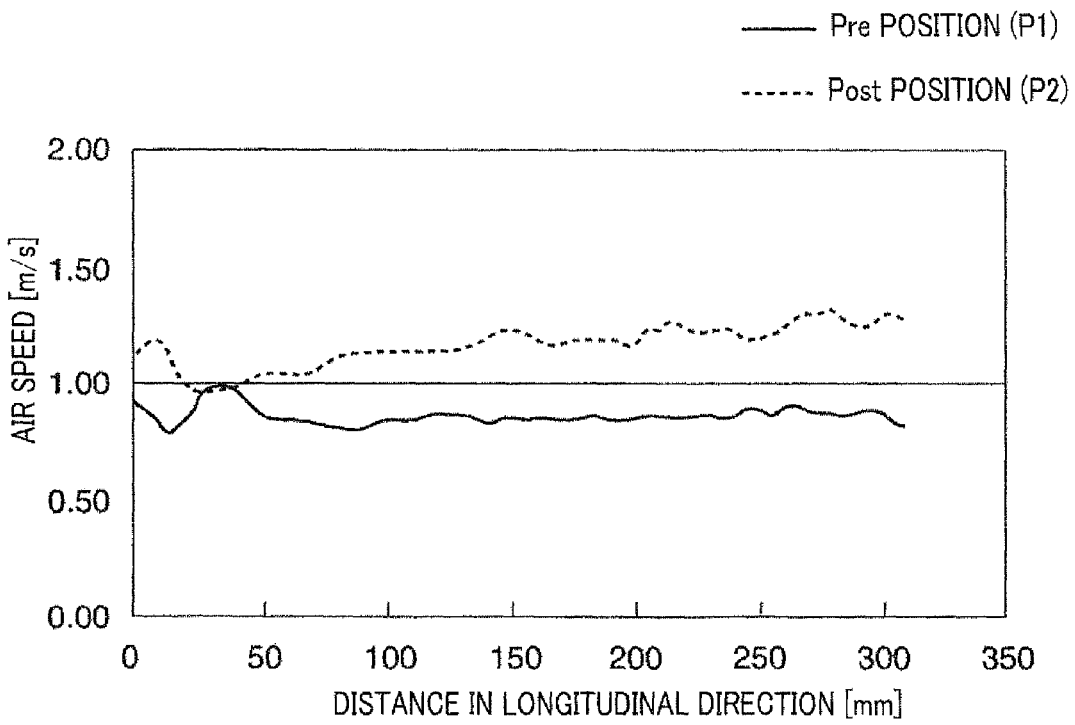

FIG. 10B shows the result of an evaluation test in which the performance characteristics of the air supply device 5 (an air speed distribution in the outlet port 53 of the air supply duct 51) are tested.

In the test, air is put from the air supply 50 with an average volume 0.33 $m^3$/minute, and the air speed (the air speed over the entire region of the outlet port in the longitudinal direction B) of air supplied from the outlet port 53 of the air supply duct 51 at this time is measured. In the measurement, an air speedometer (manufactured by CAMBRIDGE ACCU SENSE INC.: F900) is used, and as shown in FIG. 9 or 10A, the air speedometer is moved in the longitudinal direction B at two places of an end position P1 (Pre position) on the upstream side in the rotation direction A of the photoreceptor drum 21 in the outlet port 53 and an end position P2 (Post position) on the downstream side in the rotation direction A.

As the air supply duct 51, an air supply duct is used in which the entire shape is as shown in FIGS. 3 to 8 and 10A, the inlet port 52 substantially has a square opening shape of 22 mm×23 mm, and the outlet port 53 has a rectangular opening shape of 17.5 mm×350 mm. The first upstream suppressing portion 61 is configured such that the substantially flat plate-shaped partition member 64 is arranged with the gap 63 having the height H (both H1 and H2) of 1.5 mm, the path length M of 4 mm, and the width W of 345 mm. The most downstream suppressing portion 62 is configured such that the perforated member 70 in which the ventilating holes 71 having the hole diameter of 1 mm and the length of 3 mm are provided with density of 0.42/$mm^2$ (≅42/$cm^2$) to close the outlet port 53. The gap regulating portion 80 is configured by arranging the substantially flat plate-shaped member 82 to be erect in the vertical direction from the lower inner wall 55*a* of the first bent channel portion 54B such that there is the extended gap 81 having the interval S of 1.5 mm from the partition member 64 of the first upstream suppressing portion 61 and the path length R of 4 mm.

As shown in FIG. 10B, even if a large volume of air is put from the inlet port 52 of the air supply duct 51, the air speed in the longitudinal direction (B) of the outlet port 53 is close to or equal to or higher than about 1.0 m/second which is the average air speed of a target value over the entire region, and the air speed in the longitudinal direction B of the outlet port 53 is substantially uniformized. The result of the air speed at each of the Pre position P1 and the Post position P2 of the outlet port 53 is substantially equal and stable in the longitudinal direction (B) of the outlet port 53, and thus the air speed in the transverse direction C of the outlet port 53 is substantially uniformized. Incidentally, in FIG. 10B, the left end (0 mm) of the horizontal axis becomes the end portion close to the inlet port 52 in the outlet port 53 of the air supply duct 51.

Figure 20A:
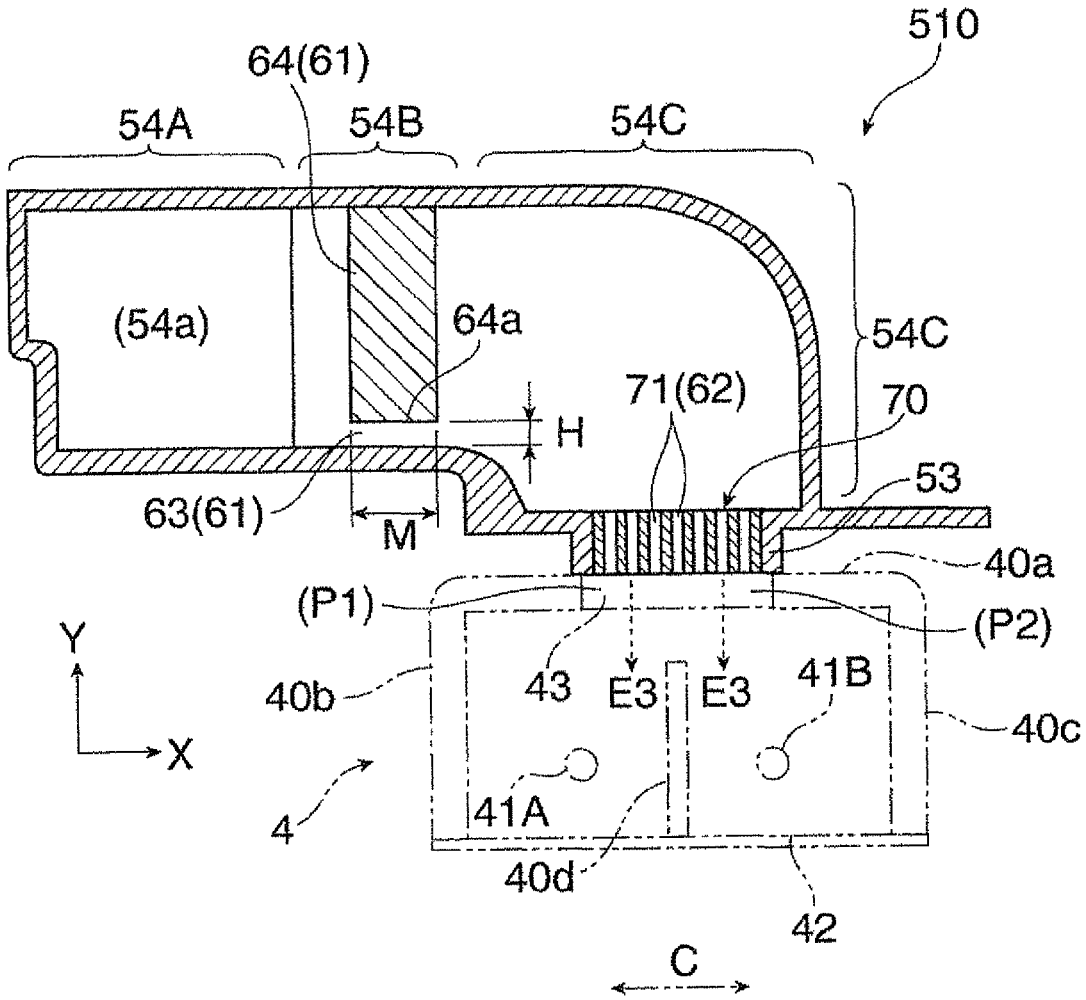
FIGS. 20A and 20B show an evaluation test relating to the performance characteristics of an air supply duct of a comparative example, specifically.

FIG. 20A shows an air supply duct 510 of a comparative example.

The air supply duct 510 has the same configuration as the air supply duct 51 of Exemplary Embodiment 1, except that no gap regulating portion 80 is provided, and the path length M of the gap 63 of the first upstream suppressing portion 61 is set to 8 mm.

Figure 20B:
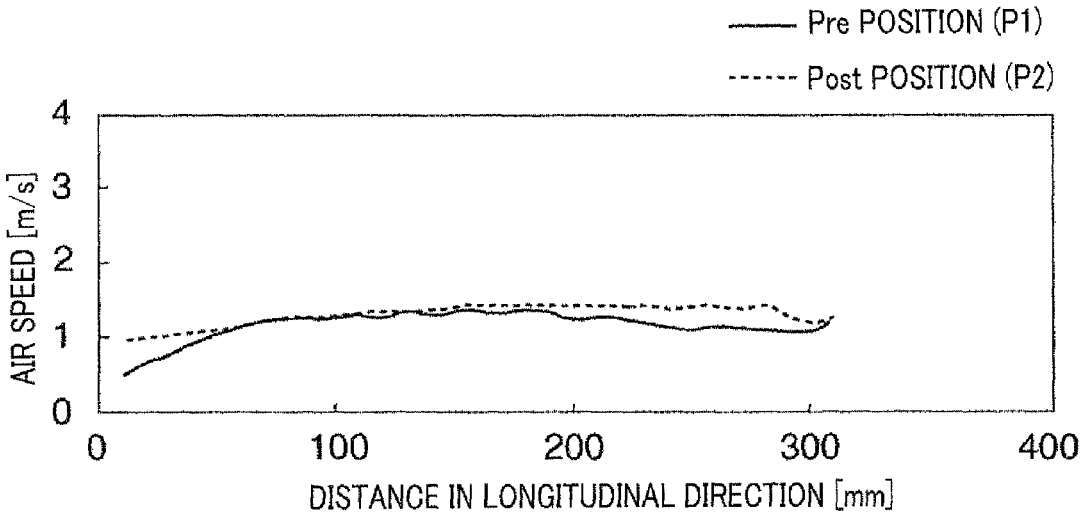

First, in the air supply duct 510 of the comparative example, when air is put from the inlet port 52 with the average volume of 0.25 $m^3$/minute for the evaluation test of the performance characteristics, as shown in FIG. 20B, the air speed of air (E3) output from the outlet port 53 is substantially uniformized in the longitudinal direction B of the opening shape (rectangular shape) of the outlet port 53, and is also uniformized in the transverse direction C. Thus, a satisfactory result is obtained.

Figure 21A:
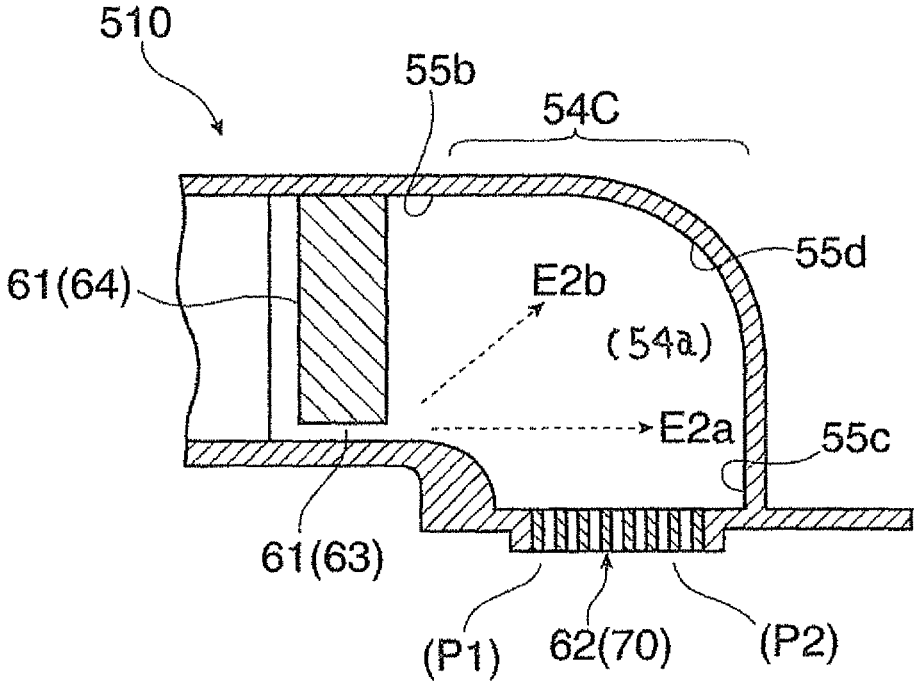
FIG. 21A is an explanatory sectional view showing the configuration and the like of a principal portion of the air supply duct of FIGS. 20A and 20B.
Figure 21B:
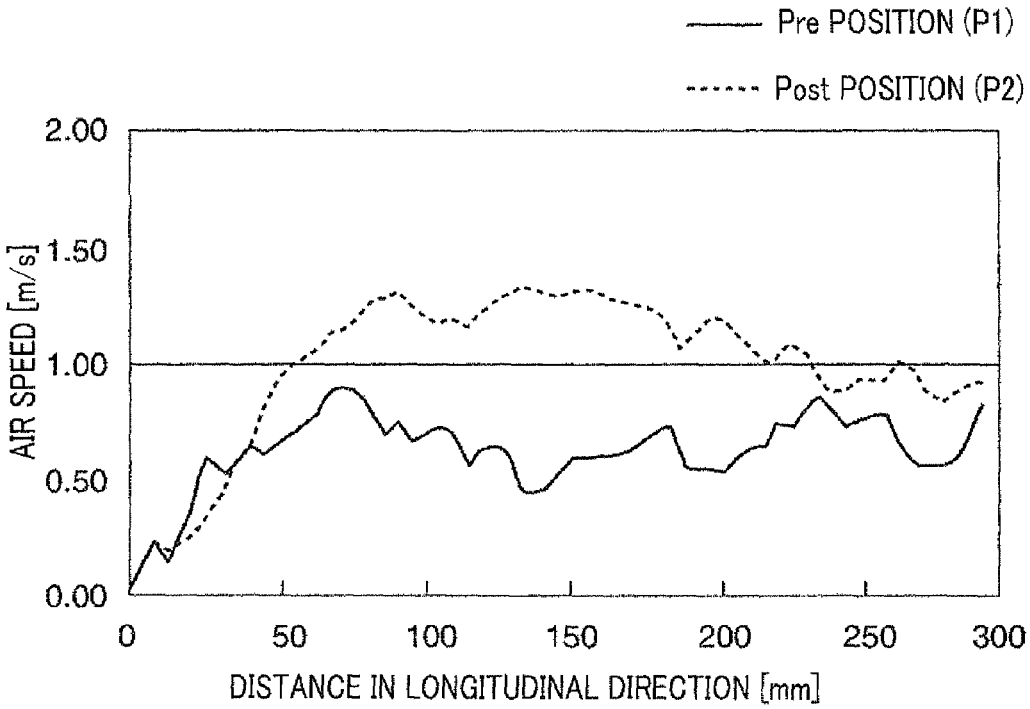
FIG. 21B is a graph showing the result of an evaluation test when the volume of air to be put is changed.

However, in the air supply duct 510, if air is put from the inlet port 52 with the average volume of 0.33 $m^3$/minute, as shown in FIG. 21B, it has been found that irregularity appears in the longitudinal direction B of the opening shape of the outlet port 53, and irregularity (difference) also appears in the transverse direction C.

In regard to the air speed in the longitudinal direction B, the air speed at the Post position is increased compared to the air speed at the Pre position.

This is presumed to be because, as shown in FIG. 21A, as the volume of air to be put is increased, a portion (E2*a*) of air having passed through the gap 63 of the first upstream suppressing portion 61 flows toward an inner wall portion 55*c* relatively close to the Post position P2 of the most downstream suppressing portion 62 (or the outlet port 53) in the channel space 54*a* of the second bent channel portion 54C, collides against the inner wall portion 55*c*, and is directly output from the ventilating holes 71 of the ventilating member 70 toward the most downstream suppressing portion 62. Another portion (E2*b*) of air having passed through the gap 53 flows toward a curved inner wall portion 55*d* in the channel space 54*a* of the second bent channel portion 54C.

The air speed at the end portion of the outlet port 53 close to the inlet port 52 is relatively decreased.

Meanwhile, like the air supply duct 51 of Exemplary Embodiment 1, if a configuration is made in which the gap regulating portion 80 is provided, a satisfactory result shown in FIG. 10B is obtained.

Figure 11A:
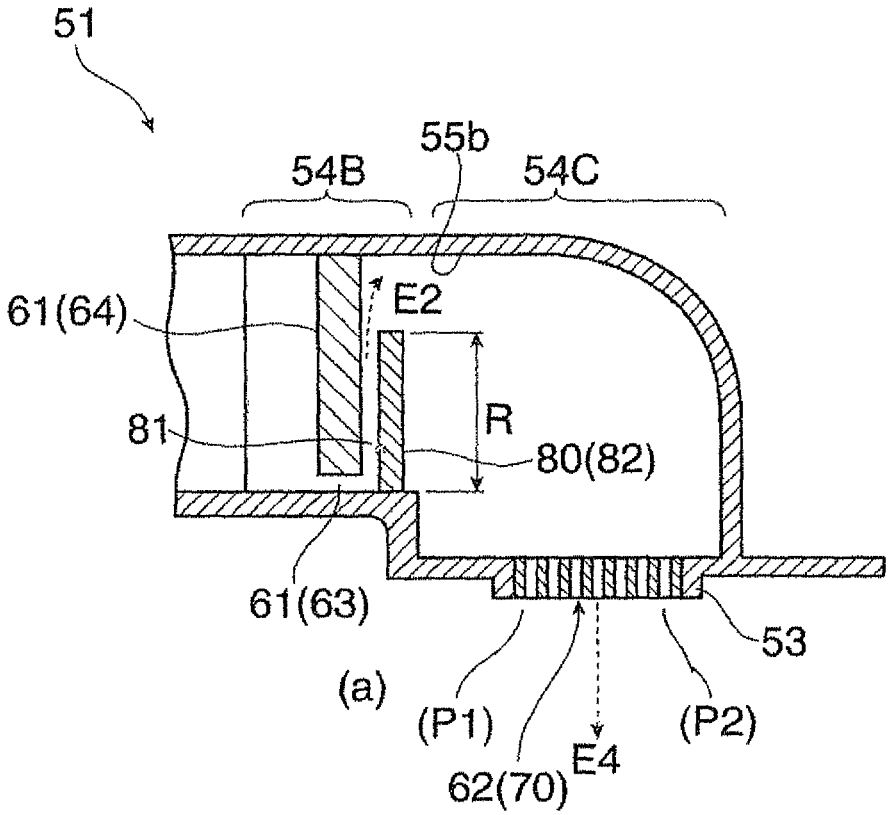
FIGS. 11A and 11B show an evaluation test relating to the performance characteristics of an air supply duct having a configuration in which a portion of the air supply duct of FIG. 4 is modified, specifically.
Figure 11B:
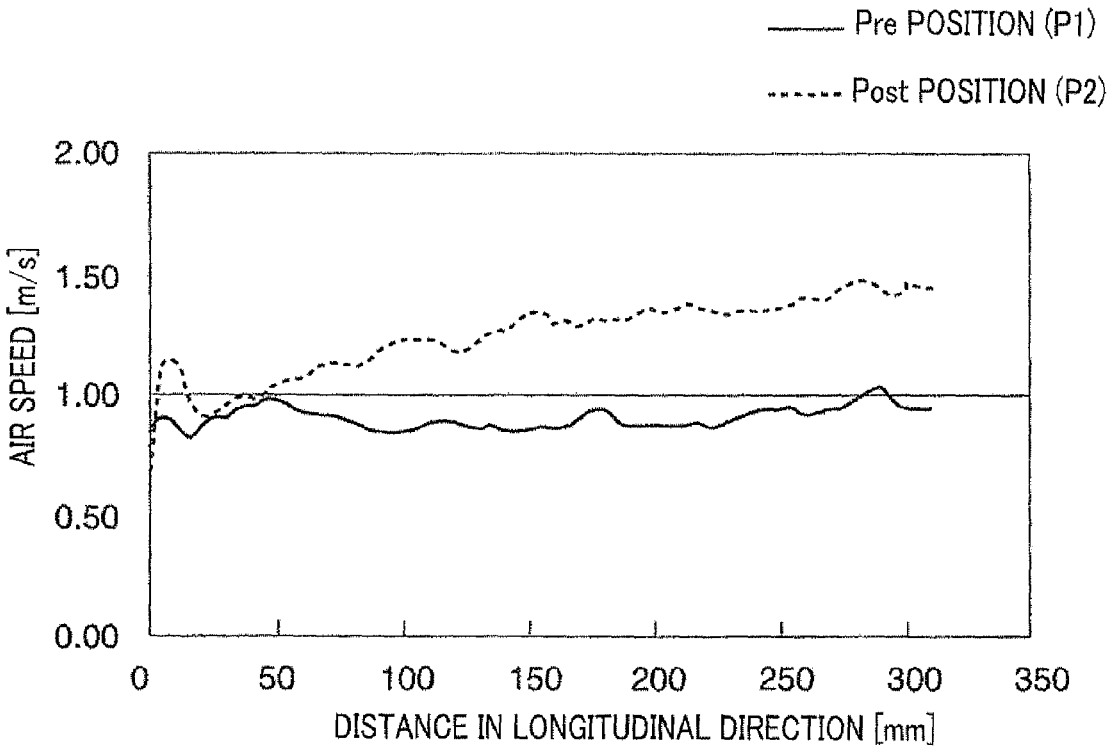

FIGS. 11A and 11B show a configuration example (FIG. 11A) of the air supply duct 51 of Exemplary Embodiment 1 in which the path length R of the gap regulating portion 80 is extended, and also show a result when the evaluation test of the performance characteristics is performed in the air supply device 5 to which the air supply duct 51 is applied (FIG. 11B).

In the air supply duct 51 at this time, the path length R of the gap regulating portion 80 is set to 8 mm. The result of the evaluation test at this time shows that the air speed of air (E4) output from the outlet port 53 is substantially uniformized in the longitudinal direction B of the opening shape (rectangular shape) of the outlet port 53, and is also uniformized in the transverse direction C. Thus, a satisfactory result is obtained. Incidentally, if the path length R of the gap regulating portion 80 is extended, the air speed in the end portion of the outlet port 53 away from the inlet port 52 (the right end of the horizontal axis in FIG. 11B) tends to be increased compared to the end portion close to the inlet port 52.

Figure 22A:
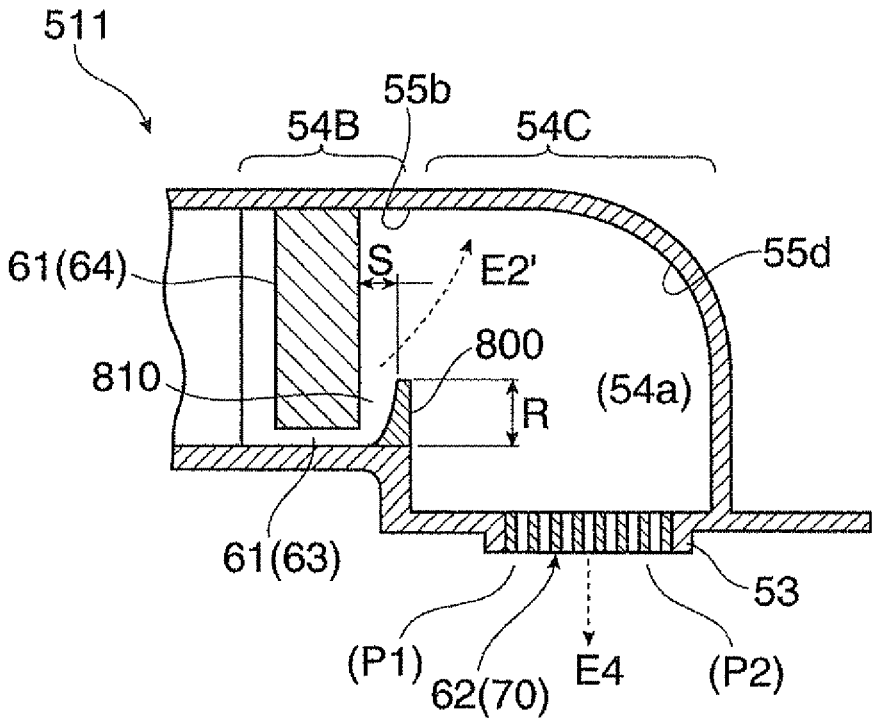
FIGS. 22A and 22B show an evaluation test relating to the performance characteristics of an air supply duct of a comparative reference example, specifically.

FIG. 22A shows an air supply duct 511 of a comparative reference example.

The air supply duct 511 has the same configuration as the air supply duct 51 of Exemplary Embodiment 1, except that a gap regulating portion 800 is provided with an extended gap 810 in which the interval S gradually increases toward the downstream side in the air flow direction. The extended gap 810 is formed such that the interval S continuously increases from the minimum value of 1.5 mm on the upstream side in the air flow direction to the maximum value of 3 mm on the downstream side.

Figure 22B:
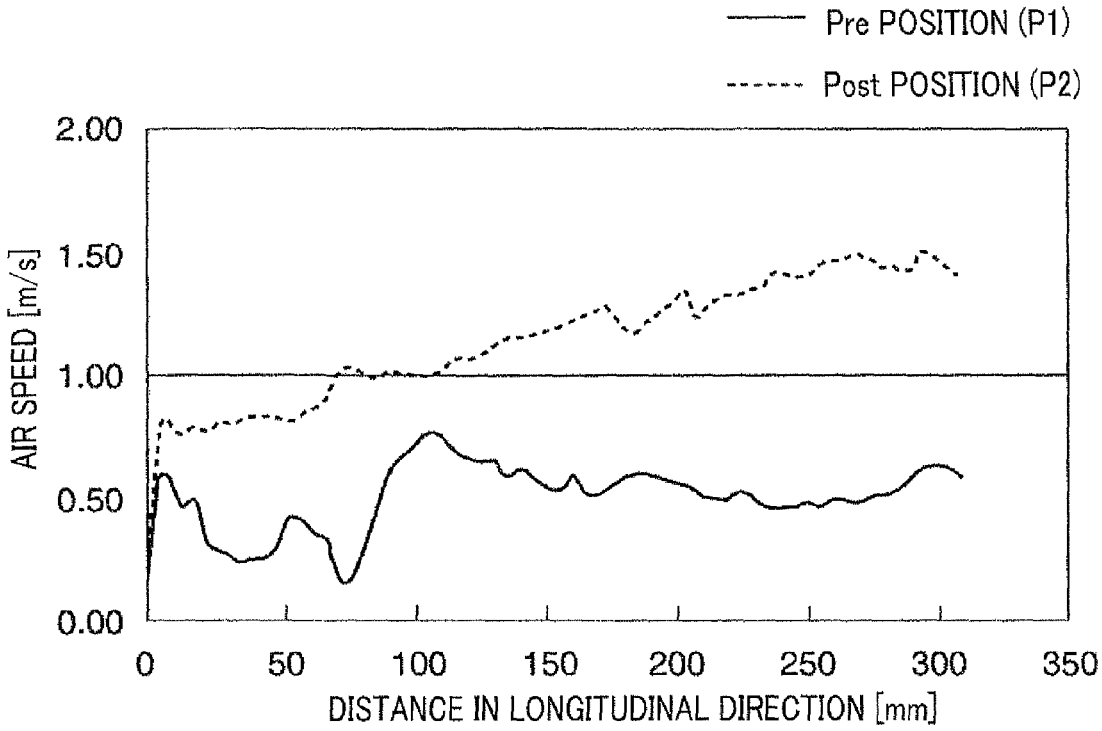

In the air supply device 5 to which the air supply duct 511 of the comparative reference example is applied, if the evaluation test (the average volume of air put from the inlet port 52=0.33 $m^3$/minute) relating to the performance characteristics is performed, as shown in FIG. 22B, irregularity in the air speed appears in the longitudinal direction B of the outlet port 53, and irregularity (difference) in the air speed also appears in the transverse direction C. In the air supply duct 511, as shown in FIG. 22A, it is found that most (E2') of air having passed through the extended gap 810 with the interval S of the gap regulating portion 800 gradually expanded flows toward a portion close to the curved inner wall portion 55*d* from the upper inner wall 55*b* farther away from the most downstream suppressing portion 62 in the channel space 54*a* of the second bent channel portion 54C, and it is thus presumed that irregularity occurs in the air speed of air (E4) output from the outlet port 53.

Other Exemplary Embodiments

Figure 12:
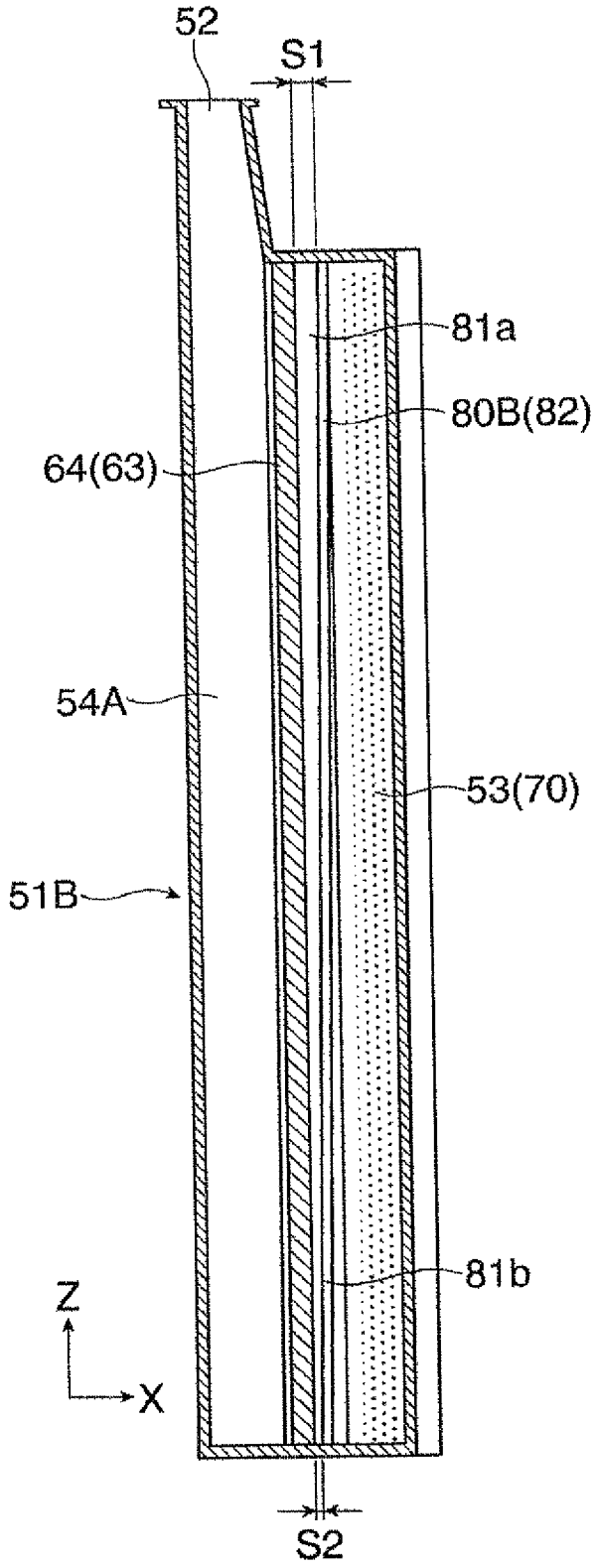
FIG. 12 is a sectional view (a sectional view of the same portion as in FIG. 7) showing an air supply duct in which a portion of the air supply duct of FIG. 4 is modified.
Figure 13A:
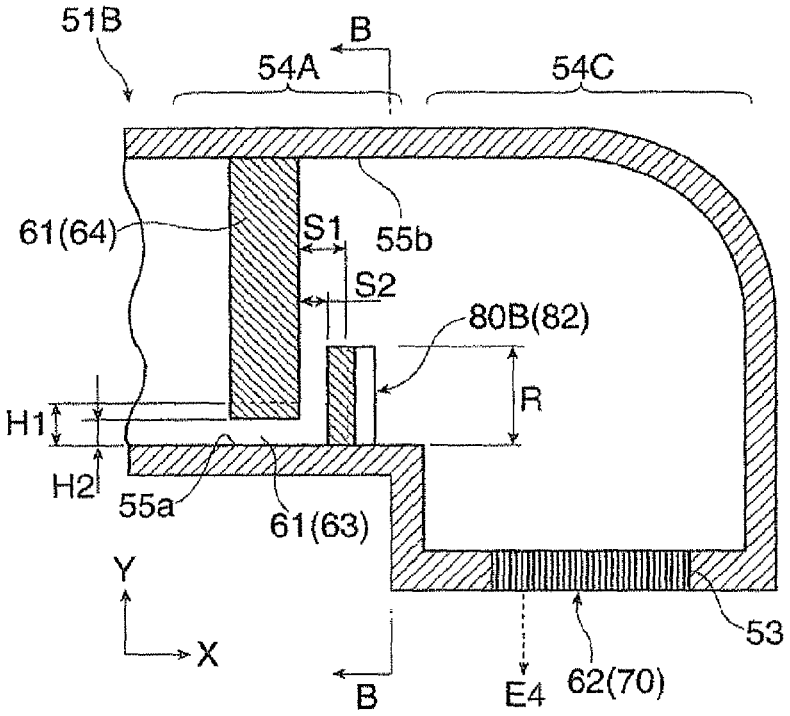
FIGS. 13A and 13B show a portion (a first upstream suppressing portion, a gap regulating portion, and the like) of the air supply duct of FIG. 12, specifically.
Figure 13B:
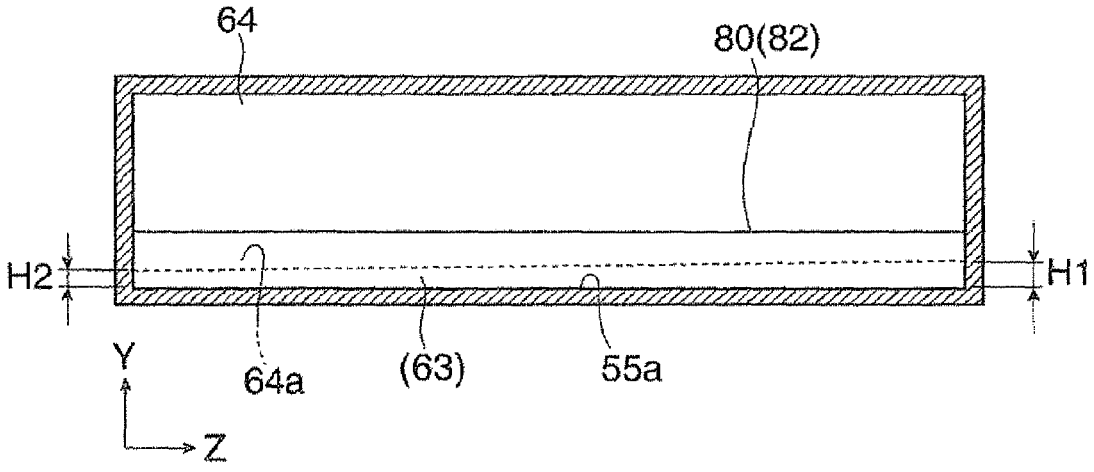

In the air supply duct 51 of the air supply device 5 of Exemplary Embodiment 1, as the gap regulating portion 80, as shown in FIG. 12 or FIGS. 13A and 13B, a gap regulating portion BOB may be provided in which an extended gap 81 is formed such that the interval S has a different value in the longitudinal direction B of the outlet port 53.

The gap regulating portion 80B shown in FIG. 12 or the like has a configuration in which a plate-shaped member 82 is arranged to be inclined relative to the partition member 64 (side) of the first upstream suppressing portion 61 such that an interval S1 is largest in the end portion close to the inlet port 52 and an interval S2 is smallest in the end portion away from the inlet port 52. When the gap regulating portion 80B is used, in regard to the gap 63 of the first upstream suppressing portion 61, as shown in FIGS. 13A and 13B, it is effective to set the height H1 to be largest in the end portion away from the inlet port 52 and the height H2 to be smallest in the end portion away from the inlet port 52. When the gap regulating portion 80B (including the gap 63 of the first upstream suppressing portion 61) is applied, the air speed of air (E4) output from the outlet port 53 in the longitudinal direction B may be further uniformized.

Figure 14:
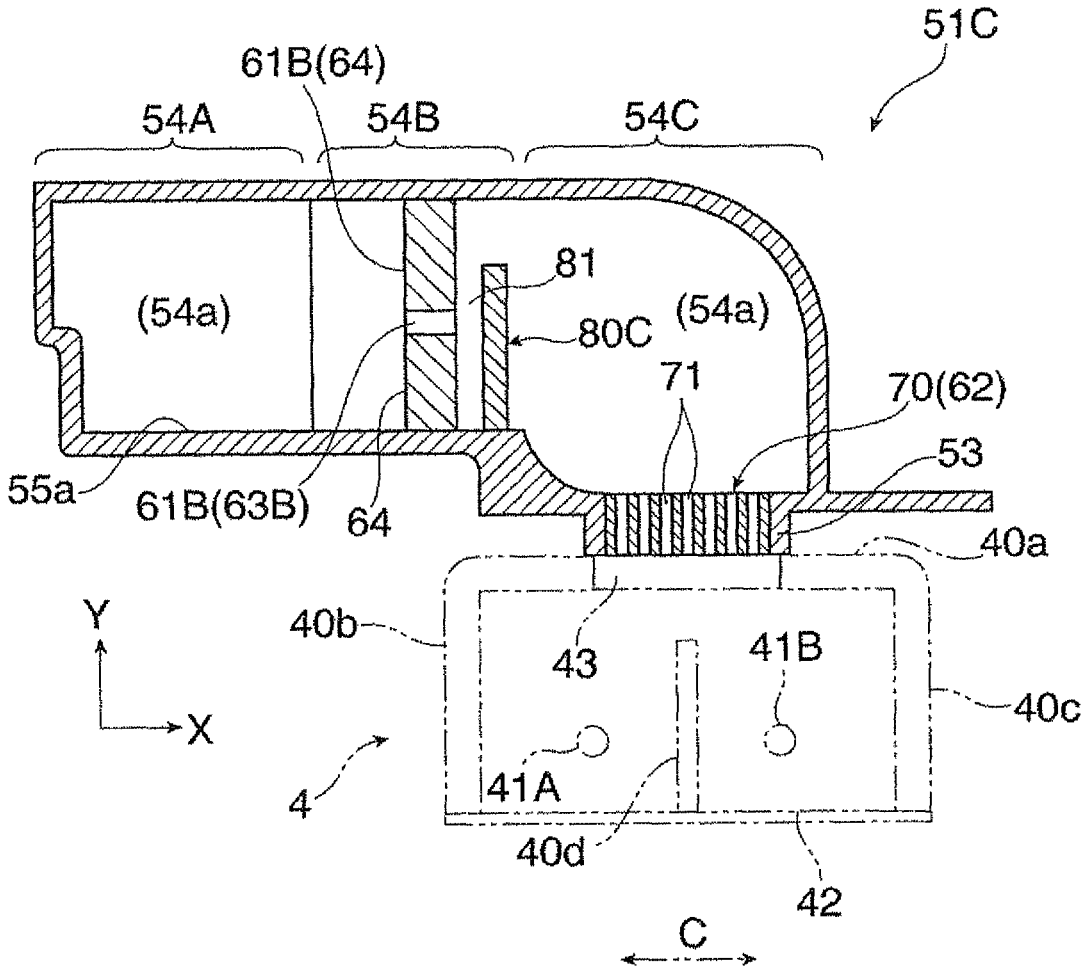
FIG. 14 is a sectional view showing another configuration example of an air supply duct.
Figure 15A:
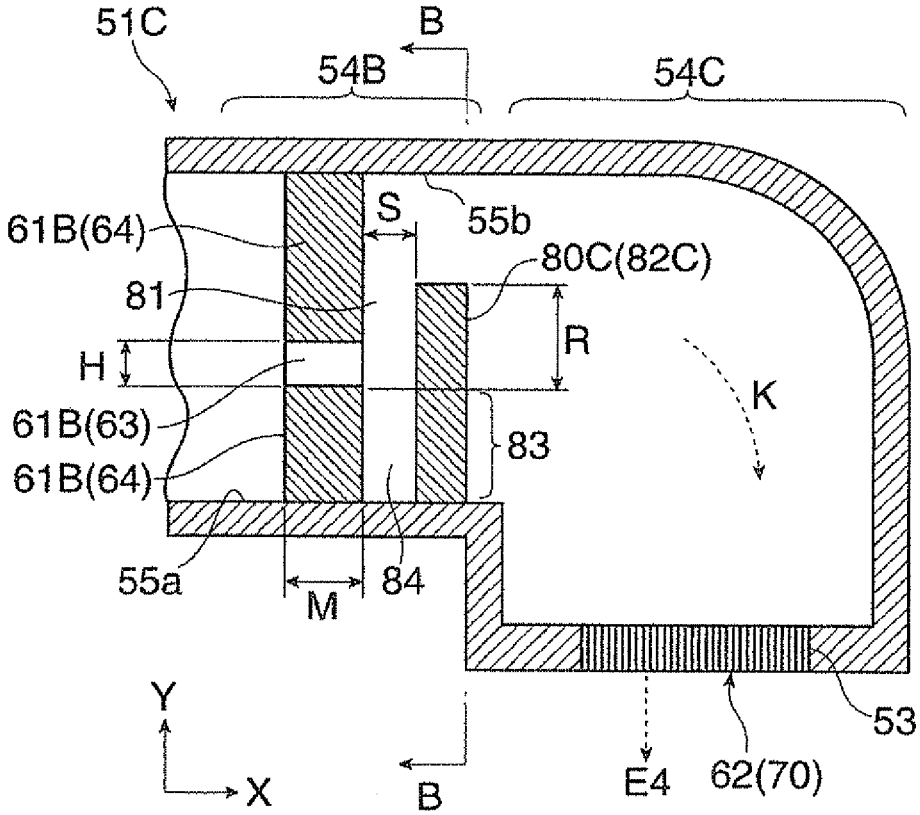
FIGS. 15A and 15B show a portion (a first upstream suppressing portion, a gap regulating portion, and the like) of the air supply duct of FIG. 14, specifically.
Figure 15B:
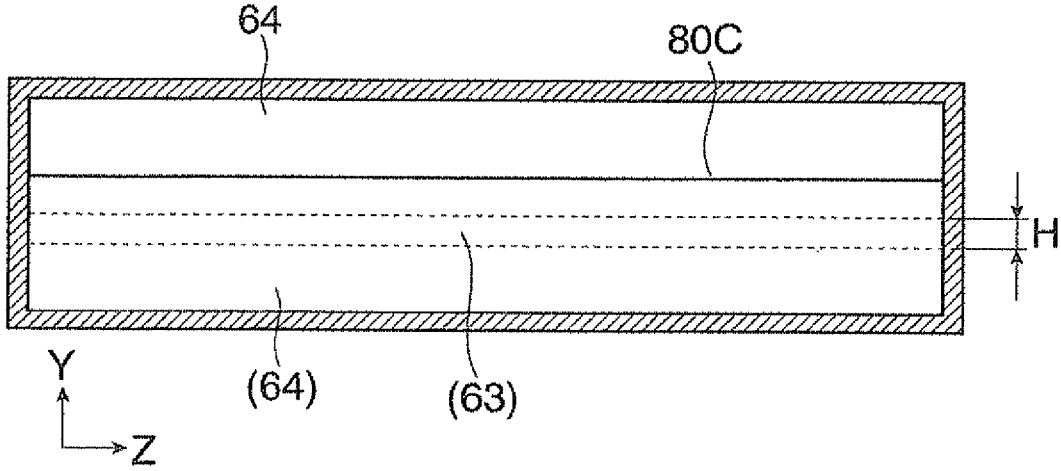

In the air supply duct 51 of the air supply device 5 of Exemplary Embodiment 1, as shown in FIG. 14 or FIGS. 15A and 15B, it is possible to apply an air supply duct 510 in which a first upstream suppressing portion 61B with a gap 63 not in contact with but close to the lower inner wall portion 55*a* in the channel space 54*a* of the first bent channel portion 54B is provided as the first upstream suppressing portion 61. A gap 53 shown in FIG. 14 or the like is provided at a position slightly downward from the central portion in the up-down direction in the channel space 54*a* of the first bent channel portion 54B.

When the air supply duct 51C is applied, for example, as shown in FIG. 14 or the like, a gap regulating portion 800 in which a plate-shaped member 82C is provided to be erect from the lower inner wall portion 55*a* in the channel space 54*a* is opposite to the gap 63 of the first upstream suppressing portion 61B at the interval S, and an extended gap 81 is formed toward the upper inner wall portion 55*b* in the channel space 54*a* between the partition member 64 of the first upstream suppressing portion 61B and the plate-shaped member 820 is provided as the gap regulating portion 80. In the gap regulating portion 800, the extended gap 81 is formed in a part of the plate-shaped member 820 opposite the gap 63 and a part on the upstream side of that part. The path length R of the extended gap 81 at this time becomes the distance from the lower surface of the gap 63 to both end portions of the plate-shaped member 820. A part 83 on the downstream side from the part of the plate-shaped member 82C opposite the gap 63 is opposite to the partition member 64 at the interval S, such that there is a space 84 between the plate-shaped member 820 and the partition member 64 (FIGS. 15A and 15B). The space 84 does not function as the extended gap 81.

In the air supply device 5 to which the air supply duct 510 is applied, if the evaluation test relating to the performance characteristics is performed, a satisfactory result (FIG. 10B) which is substantially the same as when the air supply duct 51 of Exemplary Embodiment 1 is applied is obtained.

Figure 16:
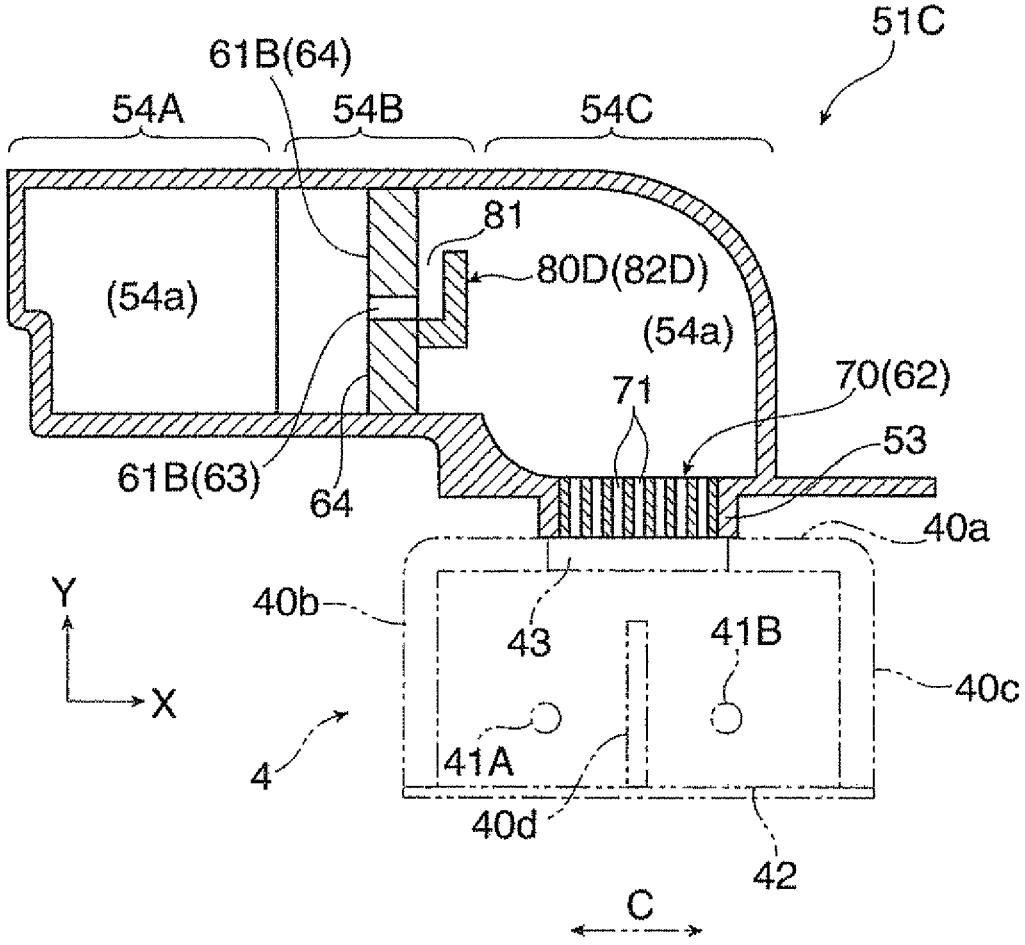
FIG. 16 is a sectional view showing still another configuration example of an air supply duct.

In the air supply duct 51C provided with the first upstream suppressing portion 61B, as shown in FIG. 16, a gap regulating portion 800 in which a plate-shaped member 820 having a sectional L shape is fixed at a lower position of the gap 63 of the partition member 64 in the first upstream suppressing portion 61B to form an extended gap 81 may be provided, instead of the gap regulating portion 80C.

When the gap regulating portion 80D having the plate-shaped member 82D is provided, there is no space 84 (FIGS. 15A and 15B) in the gap regulating portion 80C, thereby preventing air from being retained in the space 84 and increasing the capacity of the channel space 54*a* in the second bent channel portion 54C.

Figure 17:
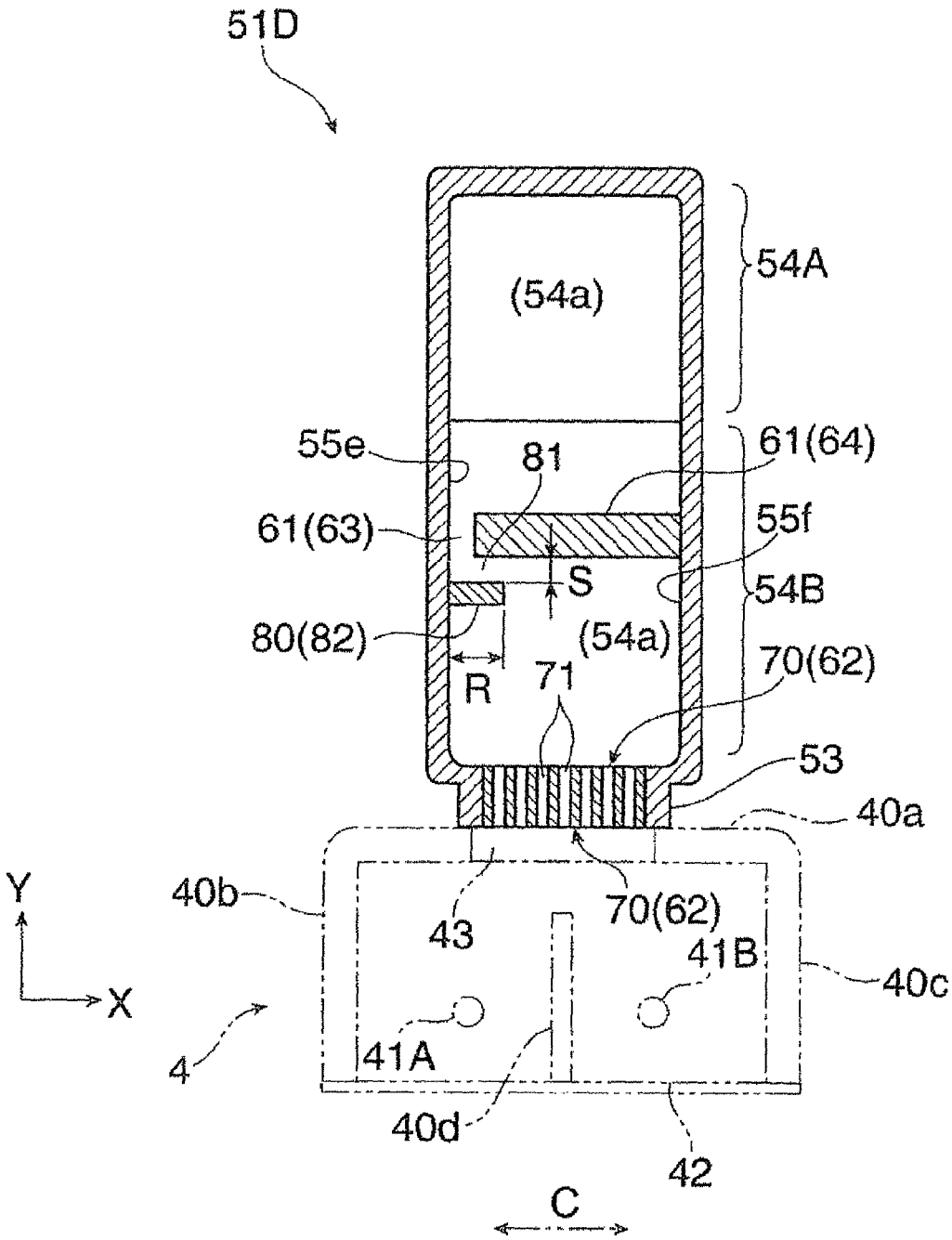
FIG. 17 is a sectional view showing still another configuration example of an air supply duct.
Figure 18:
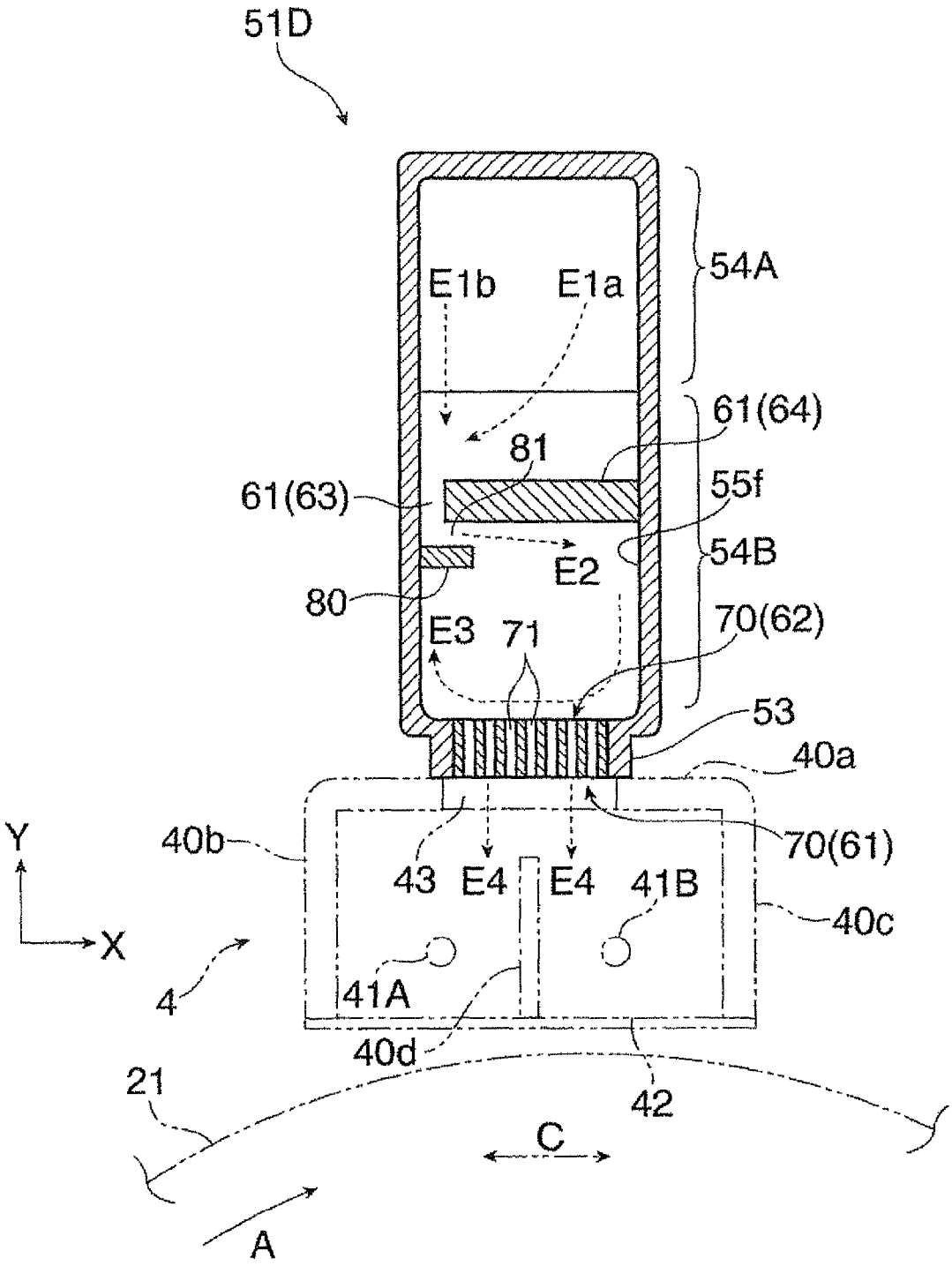
FIG. 18 is an explanatory view showing the operation state and the like of the air supply device of FIG. 17.

In the air supply duct 51 of the air supply device 5 of Exemplary Embodiment 1, an air supply duct 510 in which there is no second bent channel portion 54C (see FIG. 4 or the like), and as shown in FIG. 17 or 18, only the introduction channel portion 54A and the first bent channel portion 540 are provided may be applied. In the air supply duct 510, in the termination portion (lower portion) extending linearly in the vertical direction (the direction substantially parallel to the coordinate axis Y) to be close to the charging device 4 from one end portion of the first bent channel portion 54B with the channel space at the same width, an outlet port 53 is formed to have an opening shape slightly narrower than the sectional shape of a channel space 54*a* of the termination portion.

In the air supply duct 51D, a first upstream suppressing portion 61 and a most downstream suppressing portion 62 (see FIG. 4 or the like) of Exemplary Embodiment 1 are provided, and a gap regulating portion 80 (see FIG. 4 or the like) of Exemplary Embodiment 1 is also provided. The first upstream suppressing portion 61 at this time has a configuration in which a flat plate-shaped partition member 64 is arranged in a horizontal state in the channel space 54*a* of the first bent channel portion 54B, and a gap 53 is in contact with an inner wall portion 55*e* which becomes one of the left and right sides in the channel space 54*a*. The gap regulating portion 80 has a configuration in which a plate-shaped member 82 is provided to be erect in the horizontal direction from one inner wall portion 55*e* in the channel space 54*a* of the first bent channel portion 54B is opposite to the partition member 64 at the interval S. An extended gap 81 formed by the gap regulating portion 80 is formed as a gap extended and connected from the gap 63 of the first upstream suppressing portion 61 in a state of being bent in a direction toward the inner wall portion 55*e* which becomes the other side in the channel space 54*a* of the first bent channel portion 54B.

In the air supply device 5 to which the air supply duct 51D is applied, if the evaluation test relating to the performance characteristics is performed, a satisfactory result (FIG. 10B) which is substantially the same as when the air supply duct 51 of Exemplary Embodiment 1 is applied is obtained.

In this case, in the air supply duct 51D, as shown in FIG. 18, most (E2) of air having passed through the gap 63 of the first upstream suppressing portion 61 from the introduction channel portion 54A passes through the extended gap 81 of the gap regulating portion 80, flows toward the inner wall portion 55*e* farther away from the most downstream suppressing portion 62 (outlet port 53), and is retained to rotate in the channel space 54*a* of the first bent channel portion 54B. Finally, a part (E4) of air passes through the ventilating holes 71 of the ventilating member 70 of the most downstream suppressing portion 62 and is emitted from the outlet port 53. At this time, air (E4) which is supplied from the outlet port 53 is sent along a direction substantially perpendicular to the longitudinal direction B of the outlet port 53.

In this way, air (E4) output from the outlet port 53 with the most downstream suppressing portion 62 of the air supply duct 51D is sent in a state where the travel direction is the direction substantially perpendicular to the longitudinal direction of the outlet port 53, and the air speed is substantially uniformized. The air speed of air (E4) output from the outlet port 53 is substantially uniformized in the longitudinal direction (B) of the opening shape (rectangular shape) of the outlet port 53, and is also substantially uniformized in the transverse direction C.

As shown in FIG. 18, air (E4) sent from the outlet port 53 of the air supply duct 51D is supplied to the case 40 through the opening 43 of the shielding case 40 of the charging device 4, and is supplied to the two corona discharge wires 41A and 41B at the internal center of the case 40 and the grid electrode 42 attached to the lower opening of the case 40. Accordingly, it is possible to avoid unwanted substances, such as paper dust, external additives of toner, or corona products, which will be attached to the two discharge wires 41A and 41B and the grid electrode 42. As a result, it is possible to prevent deterioration, such as irregularity in charge performance, because unwanted products are sparsely attached to the discharge wires 41A and 41B or the grid electrode 42 in the charging device 4, making it possible to uniformly charge the peripheral surface of the photoreceptor drum 21.

Although in Exemplary embodiment 1, a case has been described where the two suppressing portions 61 and 62 are provided as a suppressing portion in the air supply duct 51 of the air supply device 5, three or more suppressing portions may be provided. It is preferable that all the suppressing portions including the most downstream suppressing portion are provided in the parts in which the sectional shape in the channel space 54*a* of the channel portion 54 of the duct 51 is changed, or in the parts after (immediately after or the like) the air flow direction in the channel space 54*a* is changed.

Although, in Exemplary Embodiment 1, a case has been described where the most downstream suppressing portion 62 has the ventilating member 70 in which plural ventilating portions (holes) 71 are substantially dotted evenly over the entire opening region of the outlet port 53, the most downstream suppressing portion 62 may be formed using the ventilating member 70 which is represented by a perforated member (the plural ventilating portions 71 are formed in an irregular form with penetrating gap), such as unwoven fabric, applied to a filter or the like.

The entire shape of the air supply duct 51 is not limited to that described in Exemplary Embodiment 1, and other shapes may be applied. For example, the air supply duct 510 (510A to 510C) shown in FIGS. 19A to 19D may be applied.

In regard to the charging device 4 to which the air supply device 5 is applied, a charging device in which no grid electrode 24 is provided, a so-called corotron charging device may be used. The charging device 4 may use one corona discharge wire 41, or three or more corona discharge wires 41. As an elongated target structure to which the air supply device 5 is applied, a corona discharger which electrically erases the photoreceptor drum 21 or the like, or a corona discharger which electrically charges or erases a member to be charged other than a photoreceptor drum may be used. An elongated structure other than a corona discharger to which air should be supplied may be used.

In regard to the image forming apparatus 1, the configuration, such as an image forming system, is not particularly limited insofar as an elongated target structure to which the air supply device 5 should be applied is provided. If necessary, an image forming apparatus which forms an image made of a material other than a developer may be provided.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An air supply tube provided with an inlet port that takes in air; and an outlet port that is arranged opposite a portion of an elongated target structure in a longitudinal direction, to which air taken in from the inlet port is to be supplied, and has an elongated opening shape in parallel to the portion of the target structure in the longitudinal direction and different from the inlet port;

the air supply tube comprising:

a channel portion in which a channel space for allowing air to flow between the inlet port and the outlet port is formed; and a plurality of suppressing portions that are provided in different parts in an air flow direction in the channel space of the channel portion and suppress the flow of air, wherein the plurality of suppressing portions include at least a most downstream suppressing portion that is provided in a most downstream-side part in the air flow direction of the channel portion and is a permeable member having a plurality of ventilation portions, a first upstream suppressing portion that is provided in a part initially located on the upstream side in the air flow direction relative to the most downstream suppressing portion in the channel portion, and is configured such that a portion of a channel space in the corresponding part is blocked along a direction parallel to the longitudinal direction of the outlet port and a gap in a shape extending in the direction parallel to the longitudinal direction of the outlet port is provided to allow air to pass therethrough, a gap regulating portion that forms an extended gap at the same interval as the gap extended and connected in a state of being bent in a direction away from the most downstream suppressing portion from the gap of the first upstream suppressing portion is provided in a part between the most downstream suppressing portion and the first upstream suppressing portion in the channel portion, and the first upstream suppressing portion extends from a first wall of the channel portion in a first direction, and the gap regulating portion extends from a second wall of the channel portion opposite to the first wall in a second direction opposite to the first direction.

2. The air supply tube according to claim 1, wherein the channel portion has a final bent channel portion having a shape in which the air flow direction is finally bent in a direction close to the target structure, the most downstream suppressing portion is provided at the outlet port at the end of the final bent channel portion, the first upstream suppressing portion is provided by arranging a plate-shaped member at a position, at which the gap is in contact with or close to an inner wall portion of a channel space corresponding to the inner side of the final bent channel portion in the bending direction in a channel space of a channel portion immediately before the final bent channel portion of the channel portion, and the gap regulating portion is provided by arranging a plate-shaped member configured to be erect in a state of being opposite to the first upstream suppressing portion at a suitable interval in a downstream-side part in the air flow direction from the first upstream suppressing portion in an inner wall portion of the channel space.

3. The air supply tube according to claim 2, wherein the target structure is a corona discharger.

4. The air supply tube according to claim 1, wherein the target structure is a corona discharger.

5. An air supply device comprising:

an air supply that sends air;

an air supply tube, the air supply tube provided with an inlet port that takes in air sent from the air supply, an outlet port that is arranged opposite a portion of an elongated target structure in a longitudinal direction, to which air taken in from the inlet port is to be supplied, and outputs air to flow in a direction perpendicular to the longitudinal direction, and a channel portion in which a channel space for allowing air to flow between the inlet port and the outlet port is formed, the outlet port being formed in an elongated opening shape parallel to a portion of the target structure in the longitudinal direction, and the inlet port and the outlet port being formed in different opening shapes; and a plurality of suppressing portions that are provided in different parts in the air flow direction in a channel space of the channel portion of the air supply tube, wherein the plurality of suppressing portions include at least a most downstream suppressing portion that is provided in a most downstream-side part in the air flow direction of the channel portion and is with a permeable member having a plurality of ventilation portions, first upstream suppressing portion that is provided in a part initially located on the upstream side in the air flow direction relative to the most downstream suppressing portion in the channel portion, and is configured such that a portion of a channel space in the corresponding part is blocked along a direction parallel to the longitudinal direction of the outlet port and a gap in a shape extending in the direction parallel to the longitudinal direction of the outlet port is provided to allow air to pass therethrough, and a gap regulating portion that forms an extended gap at the same interval as the gap extended and connected in a state of being bent in a direction away from the most downstream suppressing portion from the gap of the first upstream suppressing portion is provided in a part between the most downstream suppressing portion and the first upstream suppressing portion in the channel portion, and the first upstream suppressing portion extends from a first wall of the channel portion in a first direction, and the gap regulating portion extends from a second wall of the channel portion opposite to the first wall in a second direction opposite to the first direction.

6. The air supply device according to claim 5, wherein the channel portion has a final bent channel portion having a shape in which the air flow direction is finally bent in a direction close to the target structure, the most downstream suppressing portion is provided at the outlet port at the end of the final bent channel portion, the first upstream suppressing portion is provided by arranging a plate-shaped member at a position, at which the gap is in contact with or close to an inner wall portion of a channel space corresponding to the inner side of the final bent channel portion in the bending direction in a channel space of a channel portion immediately before the final bent channel portion of the channel portion, and the gap regulating portion is provided by arranging a plate-shaped member configured to be erect in a state of being opposite to the first upstream suppressing portion at a suitable interval in a downstream-side part in the air flow direction from the first upstream suppressing portion in an inner wall portion of the channel space.

7. The air supply device according to claim 6, wherein the target structure is a corona discharger.

8. The air supply device according to claim 5, wherein the target structure is a corona discharger.

9. An image forming apparatus comprising:

an elongated target structure to which air is to be supplied; and an air supply device that supplies air toward a portion of the target structure in a longitudinal direction, wherein the air supply device is the air supply device according to claim 5.

10. The image forming apparatus according to claim 9, wherein the target structure is a corona discharger.

* * * * *